US011282693B2

(12) United States Patent
Green et al.

(10) Patent No.: US 11,282,693 B2
(45) Date of Patent: Mar. 22, 2022

(54) QUADRUPOLE DEVICES

(71) Applicant: Micromass UK Limited, Wilmslow (GB)

(72) Inventors: Martin Raymond Green, Bowdon (GB); David Gordon, Middlewich (GB); David Langridge, Macclesfield (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/970,220

(22) PCT Filed: Feb. 15, 2019

(86) PCT No.: PCT/GB2019/050405

§ 371 (c)(1),
(2) Date: Aug. 14, 2020

(87) PCT Pub. No.: WO2019/158931

PCT Pub. Date: Aug. 22, 2019

(65) Prior Publication Data

US 2021/0082679 A1 Mar. 18, 2021

(30) Foreign Application Priority Data

Feb. 16, 2018 (GB) ..... 1802589
Feb. 16, 2018 (GB) ..... 1802601

(51) Int. Cl.
*H01J 49/42* (2006.01)
*H01J 49/00* (2006.01)

(52) U.S. Cl.
CPC ..... *H01J 49/4215* (2013.01); *H01J 49/0031* (2013.01); *H01J 49/429* (2013.01); *H01J 49/4275* (2013.01)

(58) Field of Classification Search
CPC ..... H01J 49/4215; H01J 49/0031; H01J 49/4275; H01J 49/429
See application file for complete search history.

(56) References Cited

U.S. PATENT DOCUMENTS 5,227,629 A * 7/1993 Miseki ..... H01J 49/421 250/290
5,561,291 A * 10/1996 Kelley ..... H01J 49/424 250/282

(Continued)

FOREIGN PATENT DOCUMENTS

CN 105957797 A 9/2016
GB 2278232 A 11/1994

(Continued)

OTHER PUBLICATIONS

Gershman, D. J., et al. "Higher order parametric excitation modes for spaceborne quadrupole mass spectrometers." Review of scientific instruments 82.12 (2011): 125109 (Year: 2011).*

(Continued)

*Primary Examiner* — Wyatt A Stoffa
(74) *Attorney, Agent, or Firm* — Kacvinsky Daisak Bluni PLLC

(57) ABSTRACT

A method of operating a quadrupole device is disclosed. The method comprises applying a main drive voltage to the quadrupole device and applying three or more auxiliary drive voltages to the quadrupole device. The three or more auxiliary drive voltages correspond to two or more pairs of X-band or Y-band auxiliary drive voltages.

19 Claims, 8 Drawing Sheets

(56) References Cited

U.S. PATENT DOCUMENTS

| | | | | |
|---|---|---|---|---|
| 5,747,801 | A | 5/1998 | Quarmby et al. | |
| 6,140,641 | A | 10/2000 | Yoshinari et al. | |
| 7,034,292 | B1 | 4/2006 | Whitehouse et al. | |
| 10,991,567 | B2 * | 4/2021 | Langridge | H01J 49/0031 |
| 2002/0074492 | A1 | 6/2002 | Taniguchi | |
| 2004/0232328 | A1 * | 11/2004 | Ding | H01J 49/0068 250/292 |
| 2007/0295900 | A1 | 12/2007 | Konenkov et al. | |
| 2010/0116982 | A1 | 5/2010 | Iwamoto et al. | |
| 2015/0097113 | A1 * | 4/2015 | Campbell | H01J 49/004 250/282 |
| 2018/0047549 | A1 * | 2/2018 | Quaas | H01J 49/40 |
| 2021/0082679 | A1 | 3/2021 | Green et al. | |

FOREIGN PATENT DOCUMENTS

| | | | |
|---|---|---|---|
| GB | 2301705 | A | 12/1996 |
| GB | 2421842 | A | 7/2006 |
| WO | 2017206965 | A1 | 12/2017 |
| WO | 2018046905 | A1 | 3/2018 |
| WO | 2020183159 | A1 | 9/2020 |
| WO | 2020183160 | A1 | 9/2020 |

OTHER PUBLICATIONS

Sudakov, Mikhail, et al. "Possibility of operating quadrupole mass filter at high resolution." International Journal of Mass Spectrometry 408 (2016): 9-19 (Year: 2016).*

Search Report under Section 17(5) for United Kingdom Patent Application No. GB 1802589 0, dated Aug. 2, 2018, 4 pages.

Sudakov et al., "Possibility of Operating Quadrupole Mass Filter at High Resolution", International Journal of Mass Spectrometry, vol. 408, pp. 9-19, Sep. 2016.

Sudakov et al., "The Use of Stability Bands to Improve the Performance of Quadrupole Mass Filters", Technical Physics, vol. 61, pp. 107-115, Jan. 2017.

International Search Report and Written Opinion of International Patent Application No. PCT/GB2019/050404, dated May 3, 2019, 16 pages.

Combined Search and Examination Report under Sections 17 and 18(3) for United Kingdom Patent Application No. GB1902127.8, dated Aug. 8, 2019, 6 pages.

Konenkov et al., "Quadrupole Mass Filter Acceptance in Stability Island Created by Double-Frequency Quadrupole Excitation", European Journal of Mass Spectrometry, vol. 24, pp. 315-321, Feb. 2018.

Search Report under Section 17(5) for United Kingdom Patent Application No. GB1802601.3, dated Aug. 2, 2018, 3 pages.

International Search Report and Written Opinion for International Patent Application No. PCT/GB2019/050405, dated May 8, 2019, 14 pages.

Combined Search and Examination Report under Sections 17 and 18(3) for United Kingdom Patent Application No. GB1902115.3, dated Aug. 6, 2019, 7 pages.

Combined Search and Examination Report under Sections 17 and 18(3), Application No. GB2003530.9 dated Sep. 7, 2020, 7 pages.

Konenkov, N.V., et al., "Quadrupole mass filter operation with auxiliary quadrupolar excitation: theory and experiment", International Journal of Mass Spectrometry 208:17-27 (2001).

Quadrupole Mass Spectrometry and Its Applications by P. Dawson (American Inst, of Physics, 1997) Abstract.

Combined Search and Examination Report under Sections 17 and 18(3), for Application No. GB2003532.5, dated Sep. 7, 2020, 6 pages.

International Search Report and Written Opinion for International application No. PCT/GB2020/050592, dated Jun. 16, 2020, 15 pages.

Douglas, D.J., and Konenkov, NV., "Quadrupole mass filter operation with dipole direct current and quadrupole radiofrequency excitation", Rapid Communications in Mass Spectrometry 32:1971-1977 (2018).

Examination Report under Section 18(3) for Application No. GB2003530.9, dated Jul. 30, 2021, 5 pages.

* cited by examiner

QUADRUPOLE DEVICES

CROSS-REFERENCE TO RELATED APPLICATIONS

This application is a U.S. national phase filing claiming the benefit of and priority to International Patent Application No. PCT/GB2019/050405, filed Feb. 15, 2019, which claims priority from and the benefit of United Kingdom patent application No. 1802601.3 filed on Feb. 16, 2018 and United Kingdom patent application No. 1802589.0 filed on Feb. 16, 2018. The entire contents of these applications are incorporated herein by reference.

FIELD OF THE INVENTION

The present invention relates generally to quadrupole devices and analytical instruments such as mass and/or ion mobility spectrometers that comprise quadrupole devices, and in particular to quadrupole mass filters and analytical instruments that comprise quadrupole mass filters.

BACKGROUND

Quadrupole mass filters are well known and comprise four parallel rod electrodes. FIG. 1 shows a typical arrangement of a quadrupole mass filter.

In conventional operation, an RF voltage and a DC voltage are applied to the rod electrodes of the quadrupole so that the quadrupole operates in a mass or mass to charge ratio resolving mode of operation. Ions having mass to charge ratios within a desired mass to charge ratio range will be onwardly transmitted by the mass filter, but undesired ions having mass to charge ratio values outside of the mass to charge ratio range will be substantially attenuated.

The article M. Sudakov et al., International Journal of Mass Spectrometry 408 (2016) 9-19 (Sudakov), describes a mode of operation in which two additional AC excitations of a particular form are applied to the rod electrodes of the quadrupole (in addition to the main RF and DC voltages). This has the effect of creating a narrow and long band of stability along the high q boundary near the top of the first stability region (the "X-band"). Operation in the X-band mode can offer high mass resolution and fast mass separation.

The Applicants believe that there remains scope for improvements to quadrupole devices.

SUMMARY

According to an aspect, there is provided a method of operating a quadrupole device comprising:

applying a main drive voltage to the quadrupole device; and applying three or more auxiliary drive voltages to the quadrupole device;

wherein the three or more auxiliary drive voltages correspond to two or more pairs of X-band or Y-band auxiliary drive voltages.

Various embodiments are directed to a method of operating a quadrupole device, such as a quadrupole mass filter, in which a main drive voltage is applied to the quadrupole device. In addition to this, and in contrast with known techniques, three or more auxiliary drive voltages are also applied to the quadrupole device (i.e. simultaneously with one another, and with the main drive voltage).

As will be described in more detail below, the Applicants have found that the application of three or more auxiliary drive voltages (e.g. of a particular form) to the quadrupole device, e.g. that define two or more X-band or Y-band stability conditions, can result in a new stability diagram. Operation of the quadrupole in this "hybrid X-band" or "hybrid Y-band" mode can offer a number of additional advantages compared to the known X-band or Y-band mode.

It will be appreciated, therefore, that the present invention provides an improved quadrupole device.

The method may comprise applying one or more DC voltages to the quadrupole device.

The frequency of each of the three or more auxiliary drive voltages may be different to the frequency of the main drive voltage.

The three or more auxiliary drive voltages may comprise three or more auxiliary drive voltages having at least three different frequencies.

Applying three or more auxiliary drive voltages to the quadrupole device may comprise applying three or four auxiliary drive voltages to the quadrupole device.

The main drive voltage may have a frequency $\Omega$.

The three or more auxiliary drive voltages may comprise a first pair of auxiliary drive voltages comprising a first auxiliary drive voltage having a first frequency $\omega_{ex1}$, and a second auxiliary drive voltage having a second frequency $\omega_{ex2}$, wherein the main drive voltage frequency $\Omega$ and the first and second frequencies $\omega_{ex1}$, $\omega_{ex2}$ may be related by $\omega_{ex1}=v_1\Omega$, and $\omega_{ex2}=v_2\Omega$, where $v_1$ and $v_2$ are constants.

The three or more auxiliary drive voltages may comprise a second pair of auxiliary drive voltages comprising a third auxiliary drive voltage having a third frequency $\omega_{ex3}$, and a fourth auxiliary drive voltage having a fourth frequency $\omega_{ex4}$, wherein the main drive voltage frequency $\Omega$ and the third and fourth frequencies $\omega_{ex3}$, $\omega_{ex4}$ may be related by $\omega_{ex3}=v_3\Omega$, and $\omega_{ex4}=v_4\Omega$, where $v_3$ and $v_4$ are constants.

The first pair of auxiliary drive voltages may comprise (i) a first auxiliary drive voltage pair type, wherein $v_1=v(a)$ and $v_2=1-v(a)$; (ii) a second auxiliary drive voltage pair type, wherein $v_1=v(a)$ and $v_2=1+v(a)$; (iii) a third auxiliary drive voltage pair type, wherein $v_1=1-v(a)$ and $v_2=2-v(a)$; (iv) a fourth auxiliary drive voltage pair type, wherein $v_1=1-v(a)$ and $v_2=2+v(a)$; (v) a fifth auxiliary drive voltage pair type, wherein $v_1=1+v(a)$ and $v_2=2-v(a)$; or (vi) a sixth auxiliary drive voltage pair type, wherein $v_1=1+v(a)$ and $v_2=2+v(a)$.

The second pair of auxiliary drive voltages may comprise (i) a first auxiliary drive voltage pair type, wherein $v_3=v(b)$ and $v_4=1-v(b)$; (ii) a second drive voltage pair type, wherein $v_3=v(b)$ and $v_4=1+v(b)$; (iii) a third auxiliary drive voltage pair type, wherein $v_3=1-v(b)$ and $v_4=2-v(b)$; (iv) a fourth auxiliary drive voltage pair type, wherein $v_3=1-v(b)$ and $v_4=2+v(b)$; (v) a fifth auxiliary drive voltage pair type, wherein $v_3=1+v(b)$ and $v_4=2-v(b)$; or (vi) a sixth auxiliary drive voltage pair type, wherein $v_3=1+v(b)$ and $v_4=2+v(b)$.

v(a) may be not equal to v (b).

v(a) may be equal to v (b), wherein the three or more auxiliary drive voltages may correspond to two different auxiliary drive voltage pair types.

The three or more auxiliary drive voltages may comprise a first auxiliary drive voltage having a first amplitude $V_{ex1}$, and a second auxiliary drive voltage having a second amplitude $V_{ex2}$, wherein the absolute value of the ratio $V_{ex2}/V_{ex1}$ may be in the range 1-10.

The three or more auxiliary drive voltages may comprise a third auxiliary drive voltage having a third amplitude $V_{ex3}$, and a fourth auxiliary drive voltage having a fourth amplitude $V_{ex4}$, wherein the absolute value of the ratio $V_{ex4}/V_{ex3}$ may be in the range 1-10.

The method may comprise altering the resolution or the mass to charge ratio range of the quadrupole device.

The method may comprise altering the resolution or the mass to charge ratio range of the quadrupole device by: (i) altering an amplitude of one or more of the auxiliary drive voltages; (ii) altering a phase difference between two or more of the auxiliary drive voltages; and/or (iii) altering a duty cycle of the main drive voltage.

The method may comprise altering the resolution or the mass to charge ratio range of the quadrupole device by altering an amplitude ratio between two or more of the auxiliary drive voltages.

The method may comprise altering the resolution or the mass to charge ratio range of the quadrupole device by altering the ratio of the first and/or second amplitude to the third and/or fourth amplitude.

The method may comprise altering the resolution or the mass to charge ratio range of the quadrupole device in accordance with: (i) mass to charge ratio (m/z); (ii) chromatographic retention time (RT); and/or (iii) ion mobility (IMS) drift time.

The method may comprise:

increasing the resolution of the quadrupole device while increasing the mass to charge ratio or mass to charge ratio range at which ions are selected and/or transmitted by the quadrupole device (that is, while increasing the set mass of the quadrupole device); or decreasing the resolution of the quadrupole device while decreasing the mass to charge ratio or mass to charge ratio range at which ions are selected and/or transmitted by the quadrupole device (that is, while decreasing the set mass of the quadrupole device).

As used herein, the set mass of the quadrupole device is the mass to charge ratio or the centre of the mass to charge ratio range at which ions are selected and/or transmitted by the quadrupole device.

The method may comprise:

operating the quadrupole device in a first X-band mode of operation, wherein a main drive voltage and two auxiliary drive voltages are applied to the quadrupole device; and then operating the quadrupole device in a mode of operation in which the main drive voltage and the three or more auxiliary drive voltages are applied to the quadrupole device.

The method may comprise:

operating the quadrupole device in a mode of operation in which the main drive voltage and the three or more auxiliary drive voltages are applied to the quadrupole device; and then operating the quadrupole device in a second X-band mode of operation, wherein a main drive voltage and two auxiliary drive voltages are applied to the quadrupole device.

The main drive voltage and/or the three or more auxiliary drive voltages may comprise digital drive voltages.

According to an aspect, there is provided a method of mass and/or ion mobility spectrometry comprising:

operating a quadrupole device using the method as described above; and passing ions though the quadrupole device such that the ions are selected and/or filtered according to their mass to charge ratio.

According to an aspect there is provided a quadrupole device comprising:

a plurality of electrodes; and one or more voltage sources configured to:

apply a main drive voltage to the electrodes; and apply three or more auxiliary drive voltages to the electrodes;

wherein the three or more auxiliary drive voltages correspond to two or more pairs of X-band or Y-band auxiliary drive voltages.

The quadrupole device may comprise one or more voltage sources configured to apply one or more DC voltages to the electrodes.

The frequency of each of the three or more auxiliary drive voltages may be different to the frequency of the main drive voltage.

The three or more auxiliary drive voltages may comprise three or more auxiliary drive voltages having at least three different frequencies.

Applying three or more auxiliary drive voltages to the quadrupole device may comprise applying three or four auxiliary drive voltages to the quadrupole device.

The main drive voltage may have a frequency $\Omega$.

The three or more auxiliary drive voltages may comprise a first pair of auxiliary drive voltages comprising a first auxiliary drive voltage having a first frequency $\omega_{ex1}$, and a second auxiliary drive voltage having a second frequency $\omega_{ex2}$, wherein the main drive voltage frequency $\Omega$ and the first and second frequencies $\omega_{ex1}$, $\omega_{ex2}$ may be related by $\omega_{ex1}=v_1\Omega$, and $\omega_{ex2}=v_2\Omega$, where $v_1$ and $v_2$ are constants.

The three or more auxiliary drive voltages may comprise a second pair of auxiliary drive voltages comprising a third auxiliary drive voltage having a third frequency $\omega_{ex3}$, and a fourth auxiliary drive voltage having a fourth frequency $\omega_{ex4}$, wherein the main drive voltage frequency $\Omega$ and the third and fourth frequencies $\omega_{ex3}$, $\omega_{ex4}$ may be related by $\omega_{ex3}=v_3\Omega$, and $\omega_{ex4}=v_4\Omega$, where $v_3$ and $v_4$ are constants.

The first pair of auxiliary drive voltages may comprise (i) a first auxiliary drive voltage pair type, wherein $v_1=v(a)$ and $v_2=1-v(a)$; (ii) a second auxiliary drive voltage pair type, wherein $v_1=v(a)$ and $v_2=1+v(a)$; (iii) a third auxiliary drive voltage pair type, wherein $v_1=1-v(a)$ and $v_2=2-v(a)$; (iv) a fourth auxiliary drive voltage pair type, wherein $v_1=1-v(a)$ and $v_2=2+v(a)$; (v) a fifth auxiliary drive voltage pair type, wherein $v_1=1+v(a)$ and $v_2=2-v(a)$; or (vi) a sixth auxiliary drive voltage pair type, wherein $v_1=1+v(a)$ and $v_2=2+v(a)$.

The second pair of auxiliary drive voltages may comprise (i) a first auxiliary drive voltage pair type, wherein $v_3=v(b)$ and $v_4=1-v(b)$; (ii) a second auxiliary drive voltage pair type, wherein $v_3=v(b)$ and $v_4=1+v(b)$; (iii) a third auxiliary drive voltage pair type, wherein $v_3=1-v(b)$ and $v_4=2-v(b)$; (iv) a fourth auxiliary drive voltage pair type, wherein $v_3=1-v(b)$ and $v_4=2+v(b)$; (v) a fifth auxiliary drive voltage pair type, wherein $v_3=1+v(b)$ and $v_4=2-v(b)$; or (vi) a sixth auxiliary drive voltage pair type, wherein $v_3=1+v(b)$ and $v_4=2+v(b)$.

v(a) may be not equal to v (b).

v(a) may be equal to v (b), wherein the three or more auxiliary drive voltages may correspond to two different auxiliary drive voltage pair types.

The three or more auxiliary drive voltages may comprise a first auxiliary drive voltage having a first amplitude $V_{ex1}$, and a second auxiliary drive voltage having a second amplitude $V_{ex2}$, wherein the absolute value of the ratio $V_{ex2}/V_{ex1}$ may be in the range 1-10.

The three or more auxiliary drive voltages may comprise a third auxiliary drive voltage having a third amplitude $V_{ex3}$, and a fourth auxiliary drive voltage having a fourth amplitude $V_{ex4}$, wherein the absolute value of the ratio $V_{ex4}/V_{ex3}$ may be in the range 1-10.

The quadrupole device and/or the one or more voltage sources may be configured to alter the resolution or the mass to charge ratio range of the quadrupole device.

The quadrupole device and/or the one or more voltage sources may be configured to alter the resolution or the mass to charge ratio range of the quadrupole device by: (i) altering an amplitude of one or more of the auxiliary drive voltages; (ii) altering a phase difference between two or more of the auxiliary drive voltages; and/or (iii) altering a duty cycle of the main drive voltage.

The quadrupole device and/or the one or more voltage sources may be configured to alter the resolution or the mass to charge ratio range of the quadrupole device by altering an amplitude ratio between two or more of the auxiliary drive voltages.

The quadrupole device and/or the one or more voltage sources may be configured to alter the resolution or the mass to charge ratio range of the quadrupole device by altering the ratio of the first and/or second amplitude to the third and/or fourth amplitude.

The quadrupole device and/or the one or more voltage sources may be configured to alter the resolution or the mass to charge ratio range of the quadrupole device in accordance with: (i) mass to charge ratio (m/z); (ii) chromatographic retention time (RT); and/or (iii) ion mobility (IMS) drift time.

The quadrupole device and/or the one or more voltage sources may be configured to increase the resolution of the quadrupole device while increasing the mass to charge ratio or mass to charge ratio range at which ions are selected and/or transmitted by the quadrupole device (that is, while decreasing the set mass of the quadrupole device); or decrease the resolution of the quadrupole device while decreasing the mass to charge ratio or mass to charge ratio range at which ions are selected and/or transmitted by the quadrupole device (that is, while decreasing the set mass of the quadrupole device).

The set mass of the quadrupole device may be the mass to charge ratio or the centre of the mass to charge ratio range at which ions are selected and/or transmitted by the quadrupole device.

The quadrupole device and/or the one or more voltage sources may be configured to:

operate the quadrupole device in a first X-band mode of operation, wherein a main drive voltage and two auxiliary drive voltages are applied to the quadrupole device; and then operate the quadrupole device in a mode of operation in which the main drive voltage and the three or more auxiliary drive voltages are applied to the quadrupole device.

The quadrupole device and/or the one or more voltage sources may be configured to:

operate the quadrupole device in a mode of operation in which the main drive voltage and the three or more auxiliary drive voltages are applied to the quadrupole device; and then operate the quadrupole device in a second X-band mode of operation, wherein a main drive voltage and two auxiliary drive voltages are applied to the quadrupole device.

The one or more voltage sources may comprise one or more digital voltage sources.

According to an aspect there is provided a mass and/or ion mobility spectrometer comprising a quadrupole device as described above.

According to an aspect, there is provided a method of operating a quadrupole mass filter comprising a first pair of opposing rod electrodes both placed parallel to a centre axis in a first plane, and a second pair of opposing rod electrodes both placed parallel to the centre axis in a second plane perpendicularly intersecting the first plane at the centre axis, the method comprising:

a DC power supply supplying a DC potential difference U between the two pairs of opposing rod electrodes;

a first AC power supply $P_1$ providing an AC voltage between the two pairs of opposing rods, with an amplitude of $V_1$ and a frequency of $U_1$; and applying three or more auxiliary quadrupolar excitation waveforms to the quadrupole mass filter, substantially simultaneously, at least two of which have different in frequency.

The relative and absolute amplitudes of the auxiliary waveforms may be adjusted continuously or discontinuously with (i) mass to charge ratio (m/z); and/or (ii) chromatographic retention time (RT); and/or (iii) ion mobility (IMS) drift time such that:

the transmission/resolution characteristics of the mass filter are maintained at optimum values for mass to charge ratio (m/z) range; and/or the power supply requirements are within practical limits; and/or the value of a and/or q at the operational point of the stability region are maintained at substantially the same value for a wide range of mass to charge ratio (m/z) values and mass to charge ratio (m/z) resolutions.

BRIEF DESCRIPTION OF THE DRAWINGS

Various embodiments will now be described, by way of example only, and with reference to the accompanying drawings in which.

DETAILED DESCRIPTION

Various embodiments are directed to a method of operating a quadrupole device such as a quadrupole mass filter.

Figure 1:
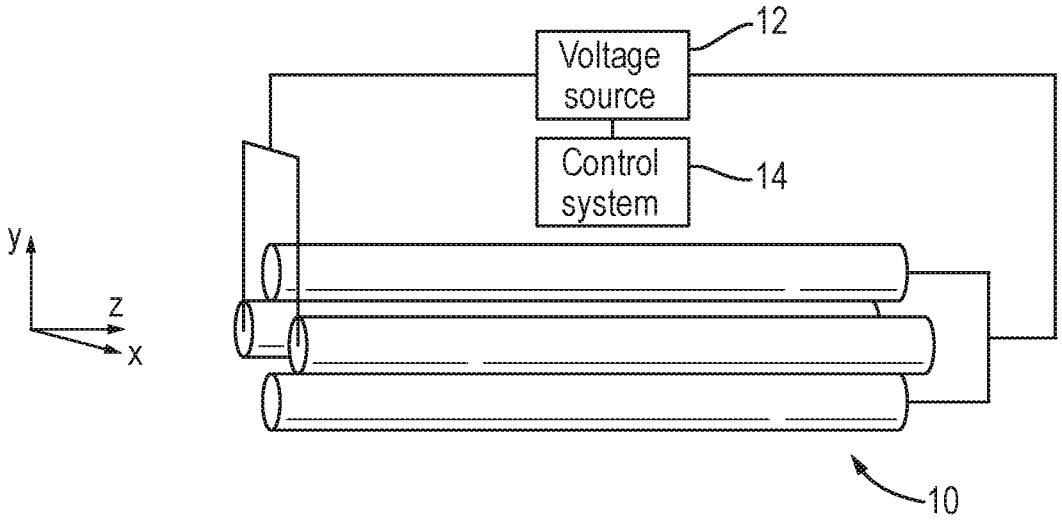
FIG. 1 shows schematically a quadrupole mass filter in accordance with various embodiments.

As illustrated schematically in FIG. 1, the quadrupole device 10 may comprise a plurality of electrodes such as four electrodes, e.g. rod electrodes, which may be arranged to be parallel to one another. The quadrupole device may comprise any suitable number of other electrodes (not shown).

The rod electrodes may be arranged so as to surround a central (longitudinal) axis of the quadrupole (z-axis) (i.e. that extends in an axial (z) direction) and to be parallel to the axis (parallel to the axial- or z-direction).

Each rod electrode may be relatively extended in the axial (z) direction. Plural or all of the rod electrodes may have the same length (in the axial (z) direction). The length of one or more or each of the rod electrodes may have any suitable value, such as for example (i)<100 mm; (ii) 100-120 mm; (iii) 120-140 mm; (iv) 140-160 mm; (v) 160-180 mm; (vi) 180-200 mm; or (vii) >200 mm.

Each of the plural extended electrodes may be offset in the radial (r) direction (where the radial direction (r) is orthogonal to the axial (z) direction) from the central axis of the ion guide by the same radial distance (the inscribed radius) $r_0$, but may have different angular (azimuthal) displacements (with respect to the central axis) (where the angular direction (θ) is orthogonal to the axial (z) direction and the radial (r) direction). The quadrupole inscribed radius $r_0$ may have any suitable value, such as for example (i)<3 mm; (ii) 3-4 mm; (iii) 4-5 mm; (iv) 5-6 mm; (v) 6-7 mm; (vi) 7-8 mm; (vii) 8-9 mm; (viii) 9-10 mm; or (ix) >10 mm.

Each of the plural extended electrodes may be equally spaced apart in the angular (θ) direction. As such, the electrodes may be arranged in a rotationally symmetric manner around the central axis. Each extended electrode may be arranged to be opposed to another of the extended electrodes in the radial direction. That is, for each electrode that is arranged at a particular angular displacement $\theta_n$ with respect to the central axis of the ion guide, another of the electrodes is arranged at an angular displacement $\theta_n \pm 180°$.

Thus, the quadrupole device 10 (e.g. quadrupole mass filter) may comprise a first pair of opposing rod electrodes both placed parallel to the central axis in a first (x) plane, and a second pair of opposing rod electrodes both placed parallel to the central axis in a second (y) plane perpendicularly intersecting the first (x) plane at the central axis.

The quadrupole device may be configured (in operation) such that at least some ions are confined within the ion guide in a radial (r) direction (where the radial direction is orthogonal to, and extends outwardly from, the axial direction). At least some ions may be radially confined substantially along (in close proximity to) the central axis. In use, at least some ions may travel though the ion guide substantially along (in close proximity to) the central axis.

As will be described in more detail below, in various embodiments (in operation) plural different voltages are applied to the electrodes of the quadrupole device 10, e.g. by one or more voltage sources 12. One or more or each of the one or more voltage sources 12 may comprise an analogue voltage source and/or a digital voltage source.

As shown in FIG. 1, according to various embodiments, a control system 14 may be provided. The one or more voltage sources 12 may be controlled by the control system 14 and/or may form part of the control system 12. The control system may be configured to control the operation of the quadrupole 10 and/or voltage source(s) 12, e.g. in the manner of the various embodiments described herein. The control system 14 may comprise suitable control circuitry that is configured to cause the quadrupole 10 and/or voltage source(s) 12 to operate in the manner of the various embodiments described herein. The control system may also comprise suitable processing circuitry configured to perform any one or more or all of the necessary processing and/or post-processing operations in respect of the various embodiments described herein.

As shown in FIG. 1, each pair of opposing electrodes of the quadrupole device 10 may be electrically connected and/or may be provided with the same voltage(s). A first phase of one or more or each (RF or AC) drive voltage may be applied to one of the pairs of opposing electrodes, and the opposite phase of that voltage (180° out of phase) may be applied to the other pair of electrodes. Additionally or alternatively, one or more or each (RF or AC) drive voltage may be applied to only one of the pairs of opposing electrodes. In addition, a DC potential difference may be applied between the two pairs of opposing electrodes, e.g. by applying one or more DC voltages to one or both of the pairs of electrodes.

Thus, the one or more voltage sources 12 may comprise one or more (RF or AC) drive voltage sources that may each be configured to provide one or more (RF or AC) drive voltages between the two pairs of opposing rod electrodes. In addition, the one or more voltage sources 12 may comprise one or more DC voltage sources that may be configured to supply a DC potential difference between the two pairs of opposing rod electrodes.

The plural voltages that are applied to (the electrodes of) the quadrupole device 10 may be selected such that ions within (e.g. travelling through) the quadrupole device 10 having a desired mass to charge ratio or having mass to charge ratios within a desired mass to charge ratio range will assume stable trajectories (i.e. will be radially or otherwise confined) within the quadrupole device 10, and will therefore be retained within the device and/or onwardly transmitted by the device. Ions having mass to charge ratio values other than the desired mass to charge ratio or outside of the desired mass to charge ratio range may assume unstable trajectories in the quadrupole device 10, and may therefore be lost and/or substantially attenuated. Thus, the plural voltages that are applied to the quadrupole device 10 may be configured to cause ions within the quadrupole device 10 to be selected and/or filtered according to their mass to charge ratio.

As described above, in conventional operation, mass or mass to charge ratio selection and/or filtering is achieved by applying a single RF voltage and a resolving DC voltage to the electrodes of the quadrupole device 10.

As also described above, the addition of two quadrupolar or parametric excitations $\omega_{ex1}$ and $w_{ex2}$ (of a particular form) (i.e. in addition to the (main) RF voltage and the resolving DC voltage) can produce a stability region near the tip of the stability diagram (in a, q dimensions) characterized in that instability at the upper and lower mass to charge ratio (m/z) boundaries of the stability region is in a single direction (e.g. in the x or y direction).

In particular, with an appropriate selection of the excitation frequencies $\omega_{ex1}$, $\omega_{ex2}$ and amplitudes $V_{ex1}$, $V_{ex2}$ of the two additional AC excitations, the influence of the two excitations can be mutually cancelled for ion motion in either the x or y direction, and a narrow and long band of stability can be created along the boundary near the top of the first stability region (the so-called "X-band" or "Y-band").

The quadrupole device 10 can be operated in either the X-band mode or the Y-band mode, but operation in the X-band mode is particularly advantageous for mass filtering as it results in instability occurring in very few cycles of the main RF voltage, thereby providing several advantages including: fast mass separation, higher mass to charge ratio (m/z) resolution, tolerance to mechanical imperfections, tolerance to initial ion energy and surface charging due to contamination, and the possibility of miniaturizing or reducing the size of the quadrupole device 10.

For operation of the quadrupole device 10 in the X-band mode, the total applied potential V(t) can be expressed as:

$$V(t)=U+V_{RF}\cos(\Omega t)+V_{ex1}\cos(\omega_{ex1}t+\alpha_{ex1})-V_{ex2}\cos(\omega_{ex2}+\alpha_{ex2}).$$

where U is the amplitude of the applied resolving DC potential, $V_{RF}$ is the amplitude of the main RF waveform, $\Omega$ is the frequency of the main RF waveform, $V_{ex1}$ and $V_{ex2}$ are the amplitudes of the first and second auxiliary waveforms, $\omega_{ex1}$ and $\omega_{ex2}$ are the frequencies of the first and second auxiliary waveforms, and $\alpha_{ex1}$ and $\alpha_{ex2}$ are the initial phases of the two auxiliary waveforms with respect to the phase of the main RF voltage. The amplitudes of the main RF and auxiliary voltages ($V_{RF}$, $V_{ex1}$ and $V_{ex2}$) are defined as positive for positive values of q.

The dimensionless parameters for the nth auxiliary waveform, $q_{ex(n)}$ a, and q may be defined as:

$$q_{ex(n)}=\frac{4eV_{ex(n)}}{M\Omega^2r_0^2},$$

$$a=\frac{8eU}{M\Omega^2r_0^2},\text{ and}$$

$$q=\frac{4eV_{RF}}{M\Omega^2r_0^2},$$

where M is the ion mass and e is its charge.

The phase offsets of the auxiliary waveforms $\alpha_{ex1}$ and $\alpha_{ex2}$ may be related to each other by:

$$\alpha_{ex2}=2\pi-\alpha_{ex1}.$$

Hence, the two auxiliary waveforms may be phase coherent (or phase locked), but free to vary in phase with respect to the main RF voltage.

The frequencies of the two parametric excitations $\omega_{ex1}$ and $\omega_{ex2}$ can be expressed as a fraction of the main confining RF frequency $\Omega$ in terms of a dimensionless base frequency v:

$$\omega_{ex1}=v_1\Omega,\text{ and }\omega_{ex2}=v_2\Omega.$$

Examples of possible excitation frequencies and relative excitation amplitudes ($q_{ex2}/q_{ex1}$) for X-band operation are shown in Table 1. The base frequency v is typically between 0 and 0.1. The optimum value of the ratio $q_{ex2}/q_{ex1}$ depends on the magnitude of $q_{ex1}$ and $q_{ex2}$ and the value of the base frequency v, and is therefore not fixed.

TABLE 1

| | I | II | III | IV | V | VI |
|---|---|---|---|---|---|---|
| $v_1$ | v | v | 1 − v | 1 − v | 1 + v | 1 + v |
| $v_2$ | 1 − v | v + 1 | 2 − v | 2 + v | 2 − v | 2 + v |
| $q_{ex2}/q_{ex1}$ | ~2.9 | ~3.1 | ~7.1 | ~9.1 | ~6.9 | ~8.3 |

The optimum ratio of the amplitudes of the two additional excitation voltages, expressed as the ratio of the dimensional parameters $q_{ex1}$ and $q_{ex2}$ (in Table 1), is dependent on the excitation frequencies chosen. Increasing or decreasing the amplitude of excitation while maintaining the optimum amplitude ratio results in narrowing or widening of the stability band and hence increases or decreases the mass resolution of the quadrupole device 10.

Figure 2:
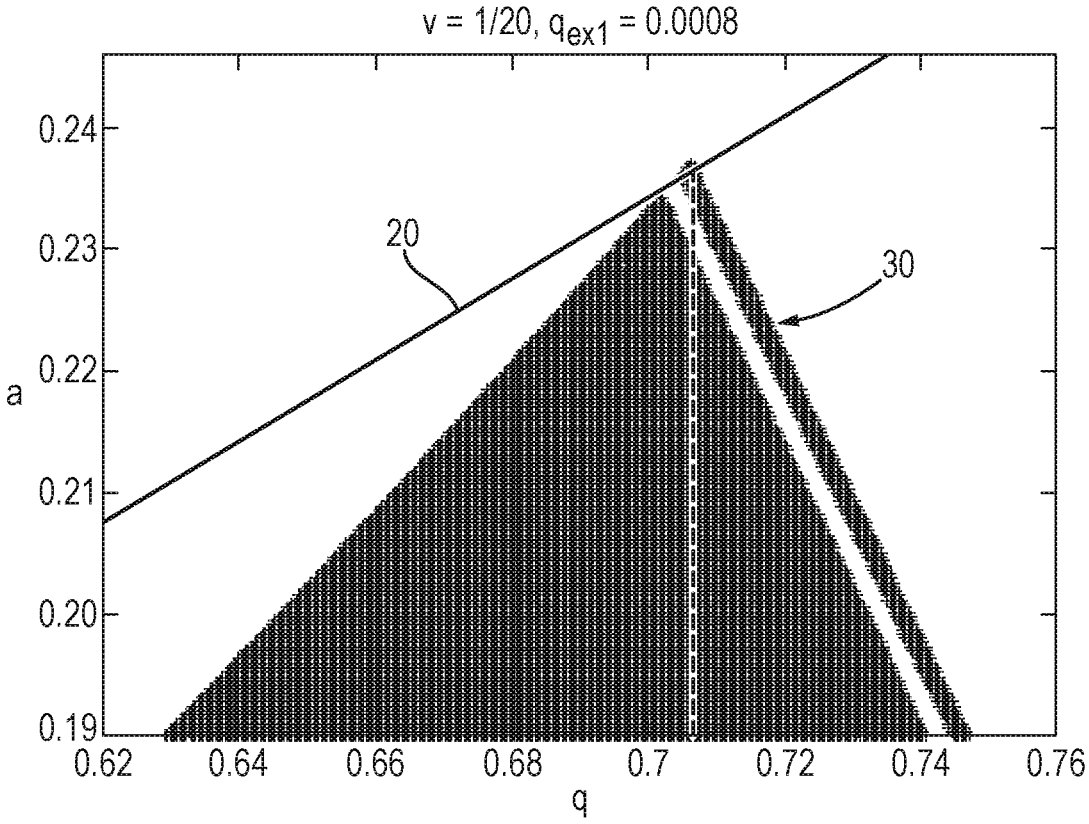
FIG. 2 shows a stability diagram for a quadrupole mass filter operating in an X-band mode of operation, where $v=1/20$, $v_1=v$, $v_2=(1-v)$, $q_{ex1}=0.0008$, and $q_{ex2}/q_{ex1}=2.915$.

FIG. 2 shows simulated data for the tip of the stability diagram (in a, q space) for X-band operation. For this model (and all simulated data herein) the following parameters were used: quadrupole inscribed radius $r_0$=5.33 mm, main RF frequency $\Omega$=1 MHz, quadrupole length z=130 mm. In addition, X-band waveforms of the type $v_1$=v, and $v_2$=(1−v) (i.e. Type I in Table 1) were used.

In the example of FIG. 2, v=1/20, $v_1$=v, $v_2$=(1−v), $q_{ext1}$=0.0008, and $q_{ext2}/q_{ext1}$=2.915. The operating line 20, i.e. where the ratio a/q is constant, is shown intersecting the X-band 30.

The resolution of the mass filter is dictated by the width of the X-band stability region 30 where it intersects the operating line 20. For the purposes of discussion herein, the resolving power R of the quadrupole mass filter 10 may be defined in terms of the ratio of the value of q at the centre of the X-band where it crosses the operating line 20 $q_{centre}$, and the difference in the value of q (Δq) from one side of the X-band to the other at this position:

$$\Delta q=q_{max}-q_{min},$$

$$q_{centre}=\frac{q_{max}-q_{min}}{2},\text{ and}$$

$$R=\frac{q_{centre}}{\Delta q}.$$

In FIG. 2, $\Delta q=2e^{-3}$, $q_{centre}$=0.705, and R=350.

Figure 3:
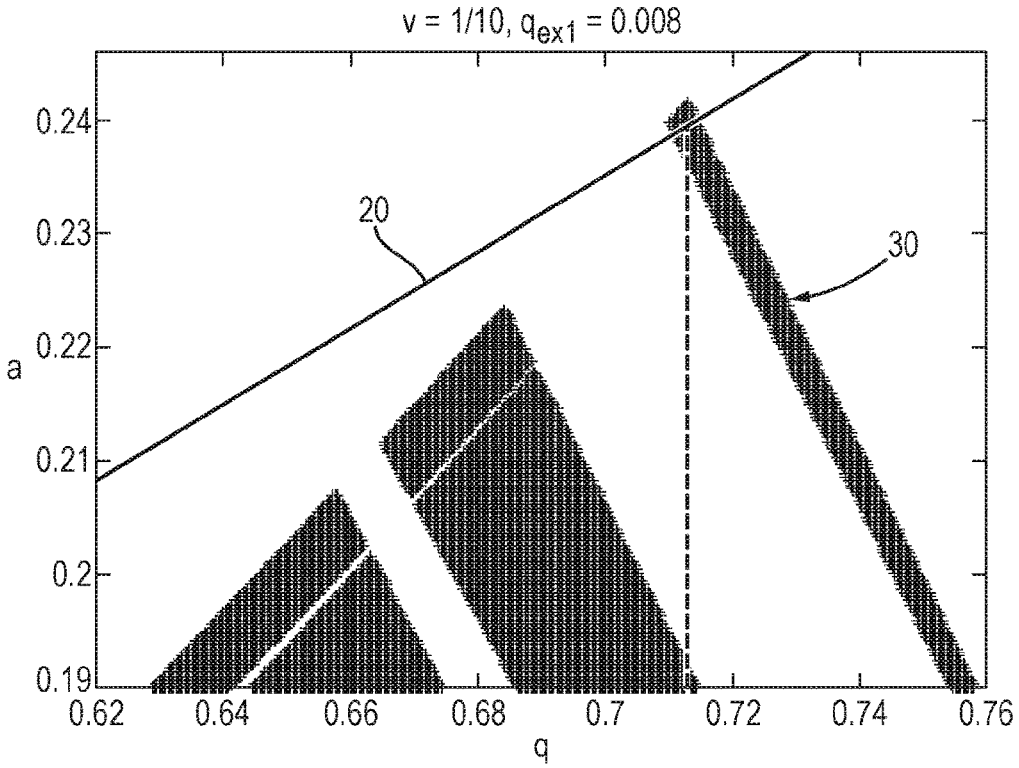
FIG. 3 shows a stability diagram for a quadrupole mass filter operating in an X-band mode of operation, where $v=1/10$, $v_1=v$, $v_2=(1-v)$, $q_{ex1}=0.008$, and $q_{ex2}/q_{ex1}=2.69$.

FIG. 3 shows the tip of the stability diagram (in a, q space) for X-band operation where v=1/10, $v_1$=v, $v_2$=(1−v), $q_{ext1}$=0.008 and $q_{ext2}/q_{ext1}$=2.69.

In FIG. 3, $\Delta q=3.6e^{-3}$, $q_{centre}$=0.711, and R=200.

Although operation of the quadrupole device 10 in the X-band mode has a number of advantages (as described above), the Applicants have recognised that further improvements can be made.

According to various embodiments, three or more auxiliary waveforms representing two or more different X-band (or Y-band) stability conditions are applied simultaneously to the quadrupole device 10. This results in a new stability diagram (a "hybrid X-band" or "hybrid Y-band") which allows X-band-like (or Y-band-like) operation, but has additional advantageous characteristics compared to the known X-band techniques. As such, various embodiments are directed to a method of superimposed X-band (or Y-band) operation.

Figure 4:
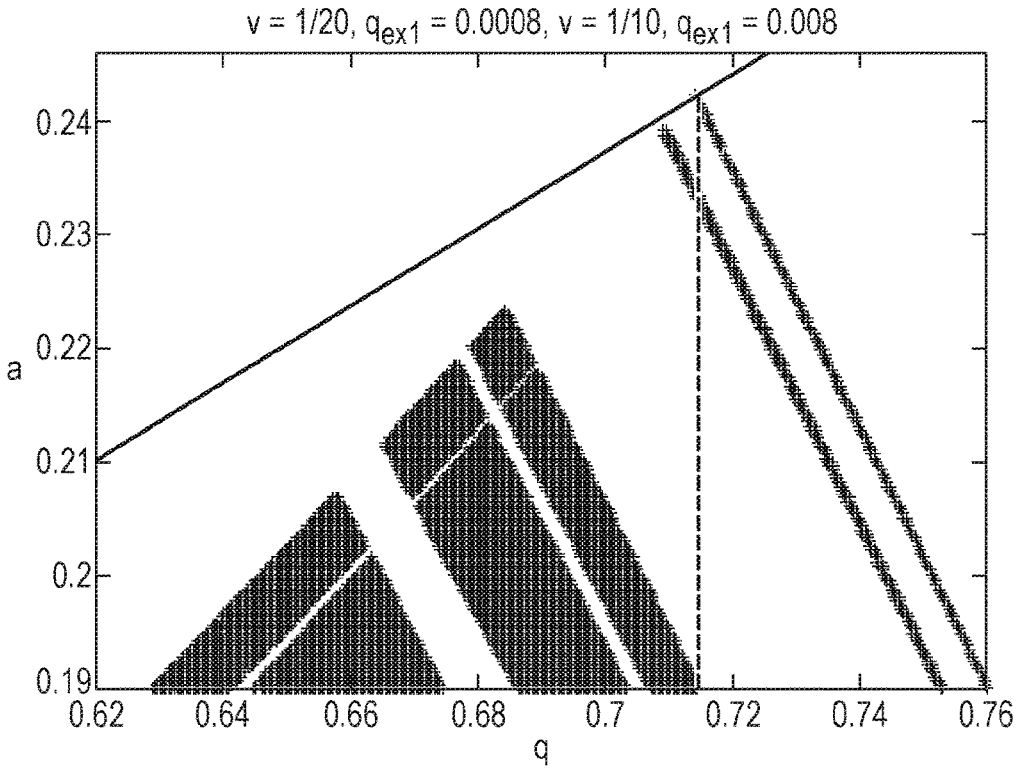
FIG. 4 shows a stability diagram for a quadrupole mass filter operating in a hybrid X-band mode of operation in accordance with various embodiments, where $v(a)=1/10$, $v_1=v(a)$, $v_2=(1-v(a))$, $q_{ext1}=0.008$, $q_{ext2}/q_{ext1}=2.69$, $v(b)=1/20$, $v_3=v(b)$, $v_4=(1-v(b))$, $q_{ext3}=0.0008$, $q_{ext4}/q_{ext3}=2.915$, and $\Delta_{\alpha 1\text{-}3}=0$.

FIG. 4 shows the tip of the stability diagram (in a, q space) with the auxiliary voltages described with respect to both FIGS. 2 and 3 applied simultaneously.

In this example two values of v are defined for the two pairs of waveforms v(a) and v(b), where v(a)=1/10, $v_1$=v(a), $v_2$=(1−v(a)), $q_{ext1}$=0.008, and $q_{ext2}/q_{ext1}$=2.69; and v(b)=1/20, $v_3$=v(b), $v_4$=(1−v(b)), $q_{ext3}$=0.0008, and $q_{ext4}/q_{ext3}$=2.915. In this example the difference in phase between the first and second pair of auxiliary waveforms was set to zero: $\Delta_{\alpha 1\text{-}3}=\alpha_{ex1}-\alpha_{ex3}=0$.

For FIG. 4, $\Delta q=4e^{-4}$, $q_{centre}$=0.714, and R=1785.

It can accordingly be seen that under these conditions, while the same amplitude of excitation waveforms as described with respect to FIGS. 2 and 3 are applied to the quadrupoles device 10, the resolution is approximately five times higher than the resolution achieved for the conditions described with respect to FIG. 2.

As such, operation in the hybrid X-band mode according to various embodiments (i.e. where three or more auxiliary waveforms representing two or more different X-band stability conditions are applied simultaneously to the quadrupole device 10) can beneficially provide a significantly increased resolution, e.g. when compared with the normal X-band mode, without increasing the maximum amplitude of excitation waveform that is applied to the quadrupole device 10. This in turn means that a significantly increased resolution can be achieved while using excitation waveform amplitudes that can be practically implemented, e.g. in terms of the power requirements of the electronics, without significantly increasing the complexity or cost of the quadrupole device 10.

It should be noted that the stability diagram of FIG. 4 is not a simple superposition of the stability diagrams of FIGS. 2 and 3 without any interaction between the two pairs of applied excitation waveforms. Instead, the two pairs of waveforms interact to provide an increased resolution. Applying a combination of two or more X-band excitation waveforms with different values of base frequency v allows many different stability conditions to be generated giving a high degree of flexibility.

Furthermore, the consequence of combining multiple different X-bands (of any value of base frequency v) is a non-trivial result. It is not immediately obvious that a combination would result in undisturbed X-band operation or any improvement of performance. On the contrary, it might be expected that such complex combinations of waveforms may result in disruption of the X-band conditions.

It will accordingly be appreciated that various embodiments provide an improved quadrupole device.

As described above, in various embodiments, the plural different voltages that are (simultaneously) applied to the electrodes of the quadrupole device 10, e.g. by the one or more voltage sources 12, comprise a main (RF or AC) drive voltage, three or more auxiliary (RF or AC) drive voltages and optionally one or more DC voltages.

The plural voltages should be (and in various embodiments are) configured (selected) so as to correspond to two (different) X-band or Y-band stability conditions. As described above, each X-band or Y-band stability condition can be generated by applying two quadrupolar or parametric excitations with frequencies $\omega_{ex1}$ and $\omega_{ex2}$ (of a particular form) (i.e. in addition to the (main) drive voltage and the optional resolving DC voltage) to the quadrupole device 10.

Thus, according to various embodiments, four auxiliary (RF or AC) drive voltages are applied to the quadrupole device 10 (i.e. in addition to the main drive voltage), e.g. comprising two pairs (i.e. a first pair and a second pair) of auxiliary drive voltages, where each pair of auxiliary drive voltages comprises an X-band or Y-band pair of auxiliary drive voltages. Thus, the plural different voltages that are (simultaneously) applied to the electrodes of the quadrupole device 10 may comprise four auxiliary (RF or AC) drive voltages (i.e. a first, second, third and fourth auxiliary (RF or AC) drive voltage). In these embodiments, the four auxiliary drive voltages may correspond to two pairs of X-band or Y-band auxiliary drive voltages.

However, as will be described in more detail below, it is also possible to produce two (different) X-band or Y-band stability conditions using only three auxiliary drive voltages, e.g. where one of the frequencies of the first pair of auxiliary drive voltages is the same as one of the frequencies of the second pair of auxiliary drive voltages. Thus, according to various embodiments, three auxiliary drive voltages are applied to the quadrupole device 10 (i.e. in addition to the main drive voltage and the optional one or more DC voltages). Thus, the plural different voltages that are (simultaneously) applied to the electrodes of the quadrupole device 10 may comprise three auxiliary (RF or AC) drive voltages (i.e. a first, second and third auxiliary (RF or AC) drive voltage)). In these embodiments, the three auxiliary drive voltages may correspond to two pairs of X-band or Y-band auxiliary drive voltages.

Thus, according to various embodiments, the plural voltages that are (simultaneously) applied to the quadrupole device 10 comprise a main drive voltage a first auxiliary drive voltage, a second auxiliary drive voltage, a third auxiliary drive voltage, and optionally a fourth auxiliary drive voltage.

It would also be possible to apply more than four auxiliary (RF or AC) drive voltages to the quadrupole device, if desired. Thus, the plural different voltages that are (simultaneously) applied to the electrodes of the quadrupole device 10 may comprise more than four auxiliary drive voltages.

The main drive voltage may have any suitable amplitude $V_{RF}$. The main drive voltage may have any suitable frequency Ω, such as for example (i)<0.5 MHz; (ii) 0.5-1 MHz; (iii) 1-2 MHz; (iv) 2-5 MHz; or (v) >5 MHz. The main drive voltage may comprise an RF or AC voltage, and e.g. may take the form $V_{RF}\cos(\Omega t)$.

Equally, each of the one or more DC voltages may have any suitable amplitude U.

Each of the auxiliary drive voltages may comprise an RF or AC voltage, and e.g. may take the form $V_{exn}$, $\cos(\omega_{exn}t+\alpha_{exn})$, where $V_{exn}$ is the amplitude of the nth auxiliary drive voltage, $\omega_{exn}$ is the frequency of the nth auxiliary drive voltage, and $\alpha_{exn}$ is an initial phase of the nth auxiliary waveform with respect to the phase of the main drive voltage.

Using the same notation as above, the total applied potential for the superposition of two pairs of auxiliary waveforms according to various embodiments can be defined as:

$$V(t) = U + V_{RF}\cos(\Omega t) + V_{ex1}\cos(\omega_{ex1}t + \alpha_{ex1}) - V_{ex2}\cos(\omega_{ex2}t + \alpha_{ex2}) + V_{ex3}\cos(\omega_{ex3}t + \alpha_{ex3}) - V_{ex4}\cos(\omega_{ex4}t + \alpha_{ex4}).$$

The voltage amplitudes are all defined to be positive for positive values of q (and negative for negative values of q).

Following this notation and the known conventions for describing ion motion in an oscillating quadrupole field, the dimensionless parameters $q_{ex(n)}$, a and q may be defined as:

$$q_{ex(n)} = \frac{4eV_{ex(n)}}{M\Omega^2 r_{0}^2},$$

$$a = \frac{8eU}{M\Omega^2 r_{0}^2}, \text{ and}$$

$$q = \frac{4eV_{RF}}{M\Omega^2 r_{0}^2}.$$

Each pair of auxiliary drive voltages may correspond to a pair of X-band or Y-band auxiliary drive voltages (e.g. as described above).

Thus, the phase offsets for each pair of auxiliary waveforms may be related in the same way as for a single X-band case, i.e.:

$$\alpha_{ex2}=2\pi-\alpha_{ex1}, \text{ and}$$

$$\alpha_{ex4}=2\pi-\alpha_{ex3}.$$

Hence, each pair of auxiliary waveforms may be phase coherent (phase locked), but may be free to vary in phase with respect to the main drive voltage.

The difference in phase ($\Delta\alpha_{ex1\text{-}3}$) between the first and second pairs of excitation waveforms may be defined as:

$$\Delta_{\alpha 1\text{-}3}=\alpha_{ex1}-\alpha_{ex3}.$$

The difference in phase ($\Delta\alpha_{ex1\text{-}3}$) between the first and second pairs of excitation waveforms may take any suitable value such as zero or a non-zero value (i.e. where $0<\Delta\alpha_{ex1\text{-}3}<2\pi$). In various embodiments the difference in phase ($\Delta\alpha_{ex1\text{-}3}$) between the first and second pairs of auxiliary drive voltages may take the value (i) 0 to $\pi/2$; (ii) $\pi/2$ to $\pi$; (iii) $\pi$ to $3\pi/2$; or (iv) $3\pi/2$ to $2\pi$.

Each of the auxiliary drive voltages may have any suitable amplitude $V_{exn}$, and any suitable frequency $\omega_{exn}$. At least three of the auxiliary drive voltages may have different frequencies. Thus, for example, where three auxiliary drive voltages are applied to the quadrupole device 10, each of the auxiliary drive voltages may have a different frequency. Where four auxiliary drive voltages are applied to the quadrupole device 10, three of the auxiliary drive voltages may have a different frequency (i.e. two of the auxiliary drive voltages may share the same frequency) or all four of the auxiliary drive voltages may each have a different frequency.

The frequencies and/or amplitudes of each pair of auxiliary drive voltages may correspond to the frequencies and/or amplitudes of an X-band or Y-band pair of auxiliary drive voltages, e.g. as described above.

Thus, the frequencies of each of the auxiliary drive voltages may be expressed as a fraction of the main confining drive frequency $\Omega$ in terms of two dimensionless base frequencies v(a) and v(b), i.e. a first dimensionless base frequency v(a) for the first pair of auxiliary drive voltages and a second dimensionless base frequency v(b) for the second pair of auxiliary drive voltages:

$$\omega_{ex1}=\nu_1\Omega, \text{ and } \omega_{ex2}=\nu_2\Omega; \text{ and}$$

$$\omega_{ex3}=\nu_3\Omega, \text{ and } \omega_{ex4}=\nu_4\Omega.$$

The relationships between the excitation frequencies $w_{exn}$ for each of the pairs of auxiliary drive voltages may each correspond to the relationship between the excitation frequencies $\omega_n$ for an X-band or Y-band pair of auxiliary drive voltages, e.g. as described above (e.g. those given above in Table 1).

Equally, the relationships between the excitation amplitudes $q_{exn}$ for each of the pairs of auxiliary drive voltages may each correspond to the relationship between the excitation amplitudes $q_{exn}$ for an X-band or Y-band pair of auxiliary drive voltages, e.g. as described above (e.g. those given above in Table 1). Thus, the absolute value of the ratio $q_{ex2}/q_{ex1}$ (i.e. $V_{ex2}/V_{ex1}$) may be in the range 1-10. Equally, the absolute value of the ratio $q_{ex4}/q_{ex3}$ (i.e. $V_{ex4}/V_{ex3}$) may be in the range 1-10.

Thus, according to various embodiments, the excitation frequencies and/or the relative excitation amplitudes ($q_{ex2}/q_{ex1}$) for the first pair of auxiliary drive voltages may be selected from Table 2.

TABLE 2

| | I | II | III | IV | V | VI |
|---|---|---|---|---|---|---|
| $v_1$ | v(a) | v(a) | 1 − v(a) | 1 − v(a) | 1 + v(a) | 1 + v(a) |
| $v_2$ | 1 − v(a) | v(a) + 1 | 2 − v(a) | 2 + v(a) | 2 − v(a) | 2 + v(a) |
| $q_{ex2}/q_{ex1}$ | ~2.9 | ~3.1 | ~7.1 | ~9.1 | ~6.9 | ~8.3 |

Correspondingly, the excitation frequencies and/or the relative excitation amplitudes ($q_{ex4}/q_{ex3}$) for the second pair of auxiliary drive voltages may be selected from Table 3.

TABLE 3

| | I | II | III | IV | V | VI |
|---|---|---|---|---|---|---|
| $v_3$ | v(b) | v(b) | 1 − v(b) | 1 − v(b) | 1 + v(b) | 1 + v(b) |
| $v_4$ | 1 − v(b) | v(b) + 1 | 2 − v(b) | 2 + v(b) | 2 − v(b) | 2 + v(b) |
| $q_{ex4}/q_{ex3}$ | ~2.9 | ~3.1 | ~7.1 | ~9.1 | ~6.9 | ~8.3 |

Each of the base frequencies v(a), v(b) may take any suitable value, such as for example (i) between 0 and 0.5; (ii) between 0 and 0.4; (iii) between 0 and 0.3; and/or (iv) between 0 and 0.2. In various particular embodiments, one or each of the base frequencies v(a), v(b) is between 0 and 0.1.

The constant v(a) may be equal to, larger than or smaller than the constant v(b).

Both of the pairs of auxiliary drive voltages may be of the same type (i.e. any one of types I to VI as defined in Tables 1-3), or the first and second pairs of auxiliary drive voltages may be of different types.

In various embodiments, the two pairs of auxiliary drive voltages correspond to two different X-bands or Y-band. This may achieved by setting the two base frequencies v(a), v(b) to be different, i.e. v(a)≠v(b) (in which case the pairs of auxiliary drive voltages may be of the same or different types). Alternatively, the three or more auxiliary drive voltages may correspond to two different X-bands or Y-band by setting the two base frequencies v(a), v(b) to be the same, i.e. v(a)=v(b), and setting the pairs of auxiliary drive voltages to be of different types.

The quadrupole device 10 may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation; a Quantification mode of operation; and/or an Ion Mobility Spectrometry ("IMS") mode of operation.

In various embodiments, the quadrupole device 10 may be operated in a constant mass resolving mode of operation, i.e. ions having a single mass to charge ratio or single mass to charge ratio range may be selected and onwardly transmitted by the quadrupole mass filter. In this case, the various parameters of the plural voltages that are applied to the quadrupole device 10 (as described above) may be (selected and) maintained and/or fixed, as appropriate.

Alternatively, the quadrupole device 10 may be operated in a varying mass resolving mode of operation, i.e. ions having more than one particular mass to charge ratio or more than one mass to charge ratio range may be selected and onwardly transmitted by the mass filter.

For example, according to various embodiments, the set mass of the quadrupole device 10 may be scanned, e.g. substantially continuously, e.g. so as to sequentially select and transmit ions having different mass to charge ratios or mass to charge ratio ranges. Additionally or alternatively, the set mass of the quadrupole device may altered discontinuously and/or discretely, e.g. between plural different values of mass to charge ratio (m/z).

In these embodiments, one or more or each of the various parameters of the plural voltages that are applied to the quadrupole device 10 (as described above) may be scanned, altered and/or varied, as appropriate.

In particular, in order to scan, alter and/or vary the set mass of the quadrupole device, the amplitude of the main drive voltage $V_{RF}$ and the amplitude of the DC voltage U may be scanned, altered and/or varied. The amplitude of the main drive voltage $V_{RF}$ and the amplitude of the DC voltage U may be increased or decreased in a continuous, discontinuous, discrete, linear, and/or non-linear manner, as appropriate. This may be done while maintaining the ratio of the main resolving DC voltage amplitude to the main RF voltage amplitude $\lambda=2U/V_{RF}$ constant or otherwise.

As transmission through the quadrupole device 10 is related to its resolution, it is often desirable to maintain a lower resolution at low mass to charge ratio (m/z) and higher resolution at higher mass to charge ratio (m/z). For example, it is common to operate a quadrupole mass filter with a fixed peak width (in Da) at each of the desired mass to charge ratio (m/z) values or over the desired mass to charge ratio (m/z) range.

Thus, according to various embodiments, the resolution of the quadrupole device 10 is scanned, altered and/or varied, e.g. over time. The resolution of the quadrupole device 10 may be varied in dependence on (i) mass to charge ratio (m/z) (e.g. the set mass of the quadrupole device); (ii) chromatographic retention time (RT) (e.g. of an eluent from which the ions are derived eluting from a chromatography device upstream of the quadrupole device); and/or (iii) ion mobility (IMS) drift time (e.g. of the ions as they pass through an ion mobility separator upstream or downstream of the quadrupole device 10).

The resolution of the quadrupole device 10 may be varied in any suitable manner. For example, one or more or each of the various parameters of the plural voltages that are applied to the quadrupole device 10 (as described above) may be scanned, altered and/or varied such that the resolution of the quadrupole device 10 is scanned, altered and/or varied.

As described above, for X-band operation, increasing or decreasing the amplitude of the auxiliary excitations (while maintaining the amplitude ratio $q_{ex2}/q_{ex1}$ constant) results in narrowing or widening of the stability band, and hence increases or decreases the mass resolution of the quadrupole device 10.

Thus, according to various embodiments, the amplitude $V_{exn}$ (or $q_{exn}$) of one or more or each of the auxiliary RF or AC voltages is varied (increased or decreased) in order to vary (increase or decrease) the resolution of the quadrupole device 10.

Returning to FIGS. 2 and 3, it can be seen that in the arrangement of FIG. 3 the value of $q_{ex1}$ is an order of magnitude higher than for the arrangement of FIG. 2. Therefore the excitation waveforms used in FIG. 3 are ten times greater in magnitude than in FIG. 2. Nevertheless, the resolution is lower for the configuration described with respect to FIG. 3 than it is for FIG. 2, i.e. despite a higher amplitude excitation waveform. This illustrates that to maintain a particular mass resolution with a higher value of the base frequency v in X-band operation, a much higher excitation amplitude must be applied.

Another observation is that the band of instability below the X-band (at lower values of q) is much narrower for v=1/20 (FIG. 2) than for v=1/10 (FIG. 3). As such, in FIG. 2 (i.e. for v=1/20), the resolution can only be lowered by a small amount (making the X-band 30 wider) before the X-band ceases to exist. In contrast, in the arrangement of FIG. 3 (i.e. for v=1/10), the resolution may be lowered further without compromising X-band operation.

As such, at higher values of the base frequency v, lower resolution is achievable whilst maintaining X-band operation, compared to operation at lower values of the base frequency v. On the other hand, the amplitude of the auxiliary waveforms required to achieve a given resolution increases with increasing values of the base frequency v.

Figure 5:
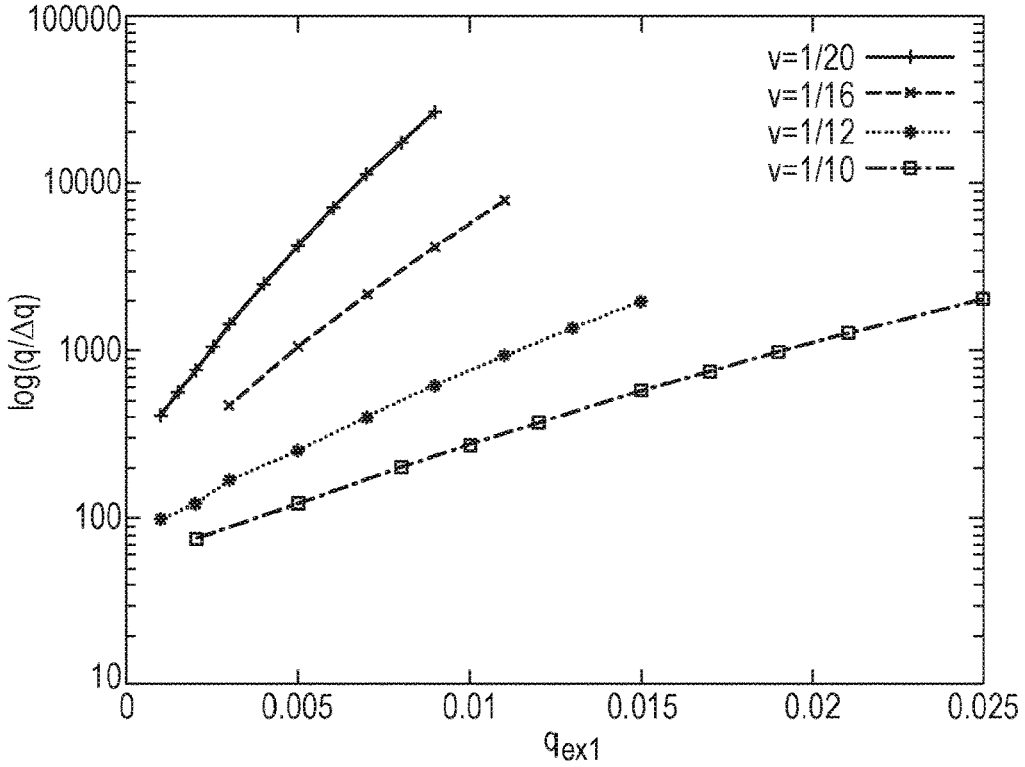
FIG. 5 shows a plot of $\log(q/\Delta q)$ versus $q_{ex1}$ for a quadrupole mass filter operating in an X-band mode of operation for four different values of base frequency v.

FIG. 5 shows a plot of log $q/\Delta q$ versus $q_{ex1}$ for four different values of v (1/20, 1/16, 1/12 and 1/10). As can be seen from FIG. 5, there is a large difference in the amplitude of excitation required to maintain the same resolution as the value of the base frequency v is increased. Lower values of the base frequency v require lower excitation amplitudes to achieve the same resolution.

On the other hand, at low mass to charge ratio (m/z), excitation with low values of the base frequency v (i.e. and therefore operation of the quadrupole device 10 with high resolution) can lead to transmission losses.

Figure 6:
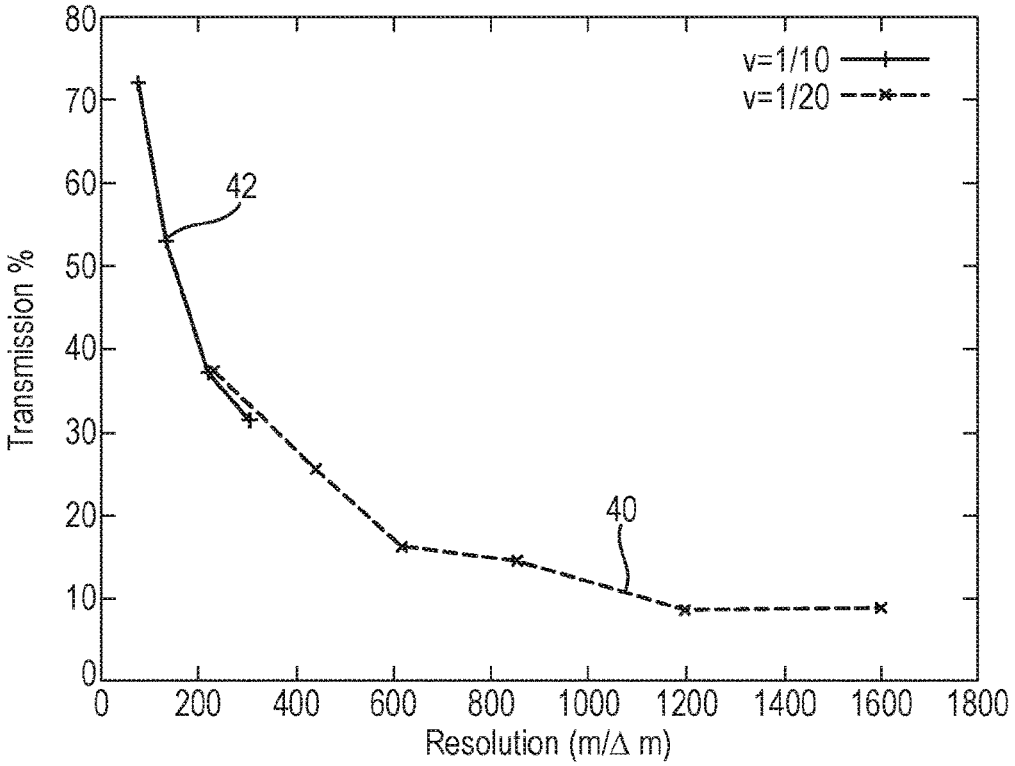
FIG. 6 shows a plot of transmission versus resolution for ions having a mass to charge ratio of 50 passing through a quadrupole mass filter operating in an X-band mode of operation for two different values of base frequency v.

FIG. 6 shows a plot of transmission (%) versus resolution for ions having a mass to charge ratio (m/z) of 50. Plot 40 shows the transmission resolution characteristic for X-band operation with excitation base frequency v=1/20. Using this excitation frequency it is not possible to maintain X-band operation with a resolution below 200 (peak width>0.25 Da). The transmission at this resolution is less than 40%.

Plot 42 shows the transmission resolution characteristic for X-band operation with excitation base frequency v=1/10. Using this excitation frequency the resolution may be adjusted to 70 (peak width 0.7 Da) at >70% transmission.

It will accordingly be appreciated that relatively low values of the base frequency v can be used to obtain relatively high resolution. However, since for relatively low values of base frequency v, the band of instability below the X-band is relatively small, it is not possible to use relatively low values of base frequency v to obtain a relatively low resolution. At higher amplitudes the working point of the X-band, in (a, q) coordinates, shifts to higher a and q values, reducing the effective mass to charge ratio (m/z) range of the quadrupole for a given maximum main RF voltage.

In contrast, relatively high values of base frequency v can be used to obtain relatively low resolution. However, for relatively high values of base frequency v, in order to obtain a relatively high resolution, very large excitation amplitudes must be used, which can be impractical and expensive to implement. In other words, using this waveform at higher mass to charge ratio (m/z) requires higher and higher excitation amplitudes which can become impractical in terms of the power requirements of the electronics.

Therefore, at low mass to charge ratio (m/z) values, it is desirable to use excitations with higher values of base frequency v. At higher mass to charge ratio (m/z), auxiliary waveforms with lower values of v and consequently lower amplitudes are desired.

One way to overcome these limitations would be to switch the frequency of the X-band excitations discontinuously at a suitable mass to charge ratio (m/z) value. However, this would mean that the position of the X-band would change abruptly at the transition point, causing the mass to charge ratio (m/z) scale to be discontinuous. This would make mass to charge ratio (m/z) calibration difficult or impossible.

In contrast with this, and in accordance with various embodiments, by blending the amplitudes of both pairs of auxiliary drive voltages (e.g. that may each have a different base frequency v) during this transition, a smooth transition can be effected allowing simple mass to charge ratio (m/z) calibration. In particular, by scanning, adjusting and/or varying the relative amplitudes of the applied auxiliary waveform pairs (e.g. which may have base frequencies v(a) and v(b)), the resolution/transmission characteristic can be seamlessly controlled over the entire mass to charge ratio (m/z) range, thereby optimizing the transmission resolution characteristics at each mass to charge ratio (m/z) value.

Several waveforms with several different values of the base frequency v may be blended in this way to cover the mass to charge ratio (m/z) range of interest without introducing discontinuities.

Thus, according to various particular embodiments, the resolution of the quadrupole device is varied by varying the relative amplitude of the two pairs of auxiliary drive voltages that are applied to the quadrupole device 10.

Thus, according to various embodiments, one or more or all of the ratios (i) $V_{ex1}/V_{ex3}$ (i.e. $q_{ex1}/q_{ex3}$); (ii) $V_{ex1}/V_{ex4}$ (i.e. $q_{ex1}/q_{ex4}$); (iii) $V_{ex2}/V_{ex3}$ (i.e. $q_{ex2}/q_{ex3}$); and/or (iv) $V_{ex2}/V_{ex4}$ (i.e. $q_{ex2}/q_{ex4}$) are varied to vary the resolution of the quadrupole device 10. This may be done, e.g. (i) by increasing or decreasing $V_{ex1}$ and/or $V_{ex2}$ ($q_{ex1}$ and/or $q_{ex2}$); (ii) by increasing or decreasing $V_{ex3}$ and/or $V_{ex4}$ ($q_{ex3}$ and/or $q_{ex4}$); (iii) by increasing $V_{ex1}$ and/or $V_{ex2}$ ($q_{ex1}$ and/or $q_{ex2}$) and decreasing $V_{ex3}$ and/or $V_{ex4}$ ($q_{ex3}$ and/or $q_{ex4}$); and/or (iv) by decreasing $V_{ex1}$ and/or $V_{ex2}$ ($q_{ex1}$ and/or $q_{ex2}$) and increasing $V_{ex3}$ and/or $V_{ex4}$ ($q_{ex3}$ and/or $q_{ex4}$).

One or more or each of the amplitudes $V_{exn}$ ($q_{exn}$) may be increased or decreased in a continuous, discontinuous, discrete, linear, and/or non-linear manner.

The range over which each of the amplitudes $V_{exn}$ ($q_{exn}$) is varied may be selected as desired. One or more or each of the amplitudes $V_{exn}$ ($q_{exn}$) may, for example, be varied between zero and a particular, e.g. selected, maximum value, and/or one or more or each of the amplitudes $V_{exn}$ ($q_{exn}$) may be varied between a particular, e.g. selected, minimum (non-zero) value and a maximum value.

According to various embodiments, the quadrupole device 10 may be operated in a first X-band or Y-band mode of operation (e.g. where a first pair of auxiliary drive voltages is applied to the quadrupole device 10), and may then be operated in a hybrid X-band or hybrid Y-band mode of operation, e.g. where three or more auxiliary drive voltages are applied to the quadrupole device 10, e.g. that correspond to the first pair of auxiliary drive voltages together with a second (different) pair of auxiliary drive voltages.

According to various embodiments, the quadrupole device 10 may be operated in a hybrid X-band or hybrid Y-band mode of operation, and may then be operated in a second X-band or Y-band mode of operation (e.g. where a second pair of auxiliary drive voltages is applied to the quadrupole device 10), e.g. where three or more auxiliary drive voltages are applied to the quadrupole device 10, e.g. that correspond to the second pair of auxiliary drive voltages together with a first (different) pair of auxiliary drive voltages in the hybrid X-band or hybrid Y-band mode of operation.

According to various embodiments, the quadrupole device 10 may be operated in a first X-band or Y-band mode of operation (e.g. where a first pair of auxiliary drive voltages are applied to the quadrupole device 10), may then be operated in a hybrid X-band or hybrid Y-band mode of operation, and may then be operated in a second (different) X-band or Y-band mode of operation (e.g. where a second (different) pair of auxiliary drive voltages are applied to the quadrupole device 10), e.g. where three or more auxiliary drive voltages that correspond to both the first and second pairs of auxiliary drive voltages are applied to the quadrupole device 10 in the hybrid X-band or hybrid Y-band mode of operation.

In these embodiments, in the first X-band or Y-band mode of operation, one or both of the amplitudes of the second pair of auxiliary drive voltages may be set to zero, and in the second X-band or Y-band mode of operation, one or both of the amplitudes of the first pair of auxiliary drive voltages may be set to zero. In the hybrid X-band or hybrid Y-band mode of operation, the ratio of the amplitudes of the first and second pairs of auxiliary drive voltages may be varied, e.g. as described above.

The relative and/or absolute amplitudes of the auxiliary waveforms may be adjusted (continuously or discontinuously) in dependence on (i) mass to charge ratio (m/z); and/or (ii) chromatographic retention time (RT); and/or (iii) ion mobility (IMS) drift time.

This may be done such that: (i) the transmission/resolution characteristics of the quadrupole device 10 (e.g. mass filter) are maintained at optimum values for each mass to charge ratio (m/z) value or range; and/or (ii) the power supply requirements are maintained within practical limits.

This may also be done such that (iii) the value of a and/or q at the operational point of the stability region are maintained at substantially the same value for a wide range of mass to charge ratio (m/z) values and mass to charge ratio (m/z) resolutions.

In this regard, another benefit according to various embodiments is that at a given mass to charge ratio (m/z) value, blending two or more X-band or Y-band waveforms can allow adjustment of the resolution without causing large shifts in q. This allows the resolution to be changed without requiring re-calibration of the mass to charge ratio (m/z) scale.

Figure 7:
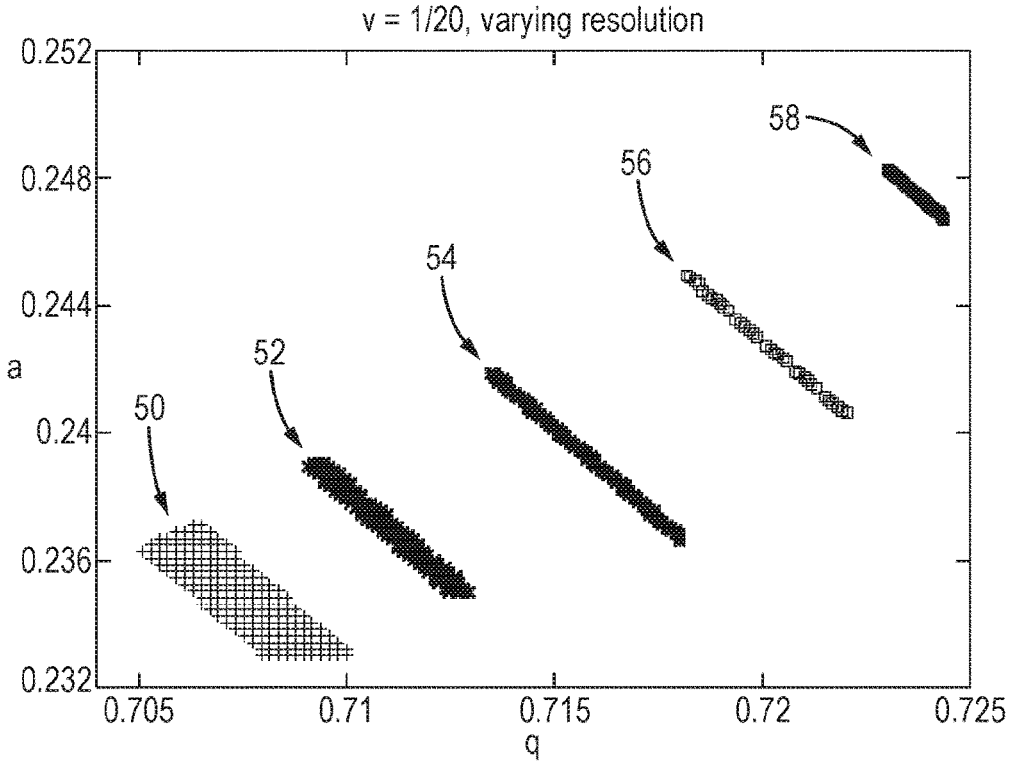
FIG. 7 shows stability diagrams for a quadrupole mass filter operating in an X-band mode of operation, where $v=1/20$ and with a phase offset of 0, for different values of the excitation waveform amplitude $q_1$.

FIG. 7 shows the superposition of a number of different X-bands at the tip of the stability diagram with a single pair of excitation waveforms applied with base frequency 1/20 and different values excitation waveform amplitude $q_1$ with a phase offset of 0.

As $q_1$ is varied between 0.001 (plot 50), 0.003 (plot 52), 0.005 (plot 54), 0.007 (plot 56), and 0.009 (plot 58), to give progressively higher resolution, the tip of the X-band changes position from 0.707 to 0.723 in q. There is also a significant change in the position of the tip in the a dimension.

In practice this means that as the resolution is changed, the relationship between mass to charge ratio (m/z) position and $V_{RF}/U$ is no longer substantially linear. This requires a complex calibration over the entire mass to charge ratio (m/z) and resolution range.

Furthermore, for the same X-band width (Δq), the tip location is higher in q,a coordinates for a larger base frequency v. Thus, it can be seen in FIGS. 2 and 3 that the tip location for the v=1/10 X-band 30 (in FIG. 3) is higher in q,a coordinates than the tip location for the v=1/20 X-band 30 (in FIG. 2), despite giving a lower resolution.

In contrast, when using the multiple X-band mode of operation according to various embodiments, by varying the relative amplitudes of the excitation voltages of the two pairs of waveforms (i.e. the two waveforms which may have base frequencies v(a) and v(b)), the stability diagram can be tuned to obtain different resolutions, while the tip location is substantially fixed in q,a coordinates. This is beneficial in that the need to adjust the scan line is reduced and a simpler mass calibration is required. This is not possible with single X-band operation.

Figure 8:
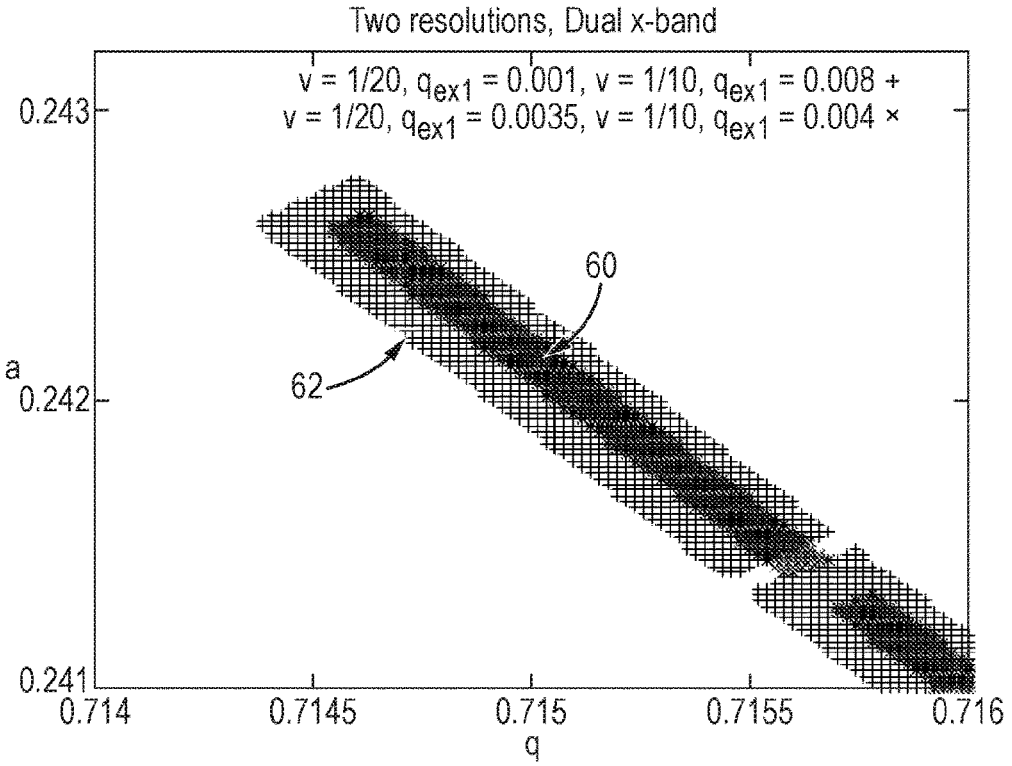
FIG. 8 shows two superimposed stability diagrams for a quadrupole mass filter operating in a hybrid X-band mode of operation in accordance with various embodiments, where $v(a)=1/20$ and $v(b)=1/10$.

FIG. 8 shows two superimposed hybrid X-band stability regions at the tip of the stability diagram. Both stability diagrams are generated using a combination of waveforms with v(a)=1/20 and v(b)=1/10 (as in FIG. 4). For the narrower hybrid X-band 60, $q_1$=0.001 and $q_3$=0.008. For the wider hybrid X-band 62, $q_1$=0.0035 and $q_3$=0.004. Δq and $q_{centre}$ for the two X-bands are $\Delta q=1.3e^{-4}$, $q_{centre}$=0.7145, and $\Delta q=3e^{-4}$, $q_{centre}$=0.7145.

It can be seen that the two stability regions overlap in q, a dimensions, but have different resolutions. This illustrates that the hybrid X-band mode according to various embodiments can be used to allow adjustment of the resolution of the quadrupole device 10 without causing large shifts in q, and without requiring complex calibration.

Figure 9:
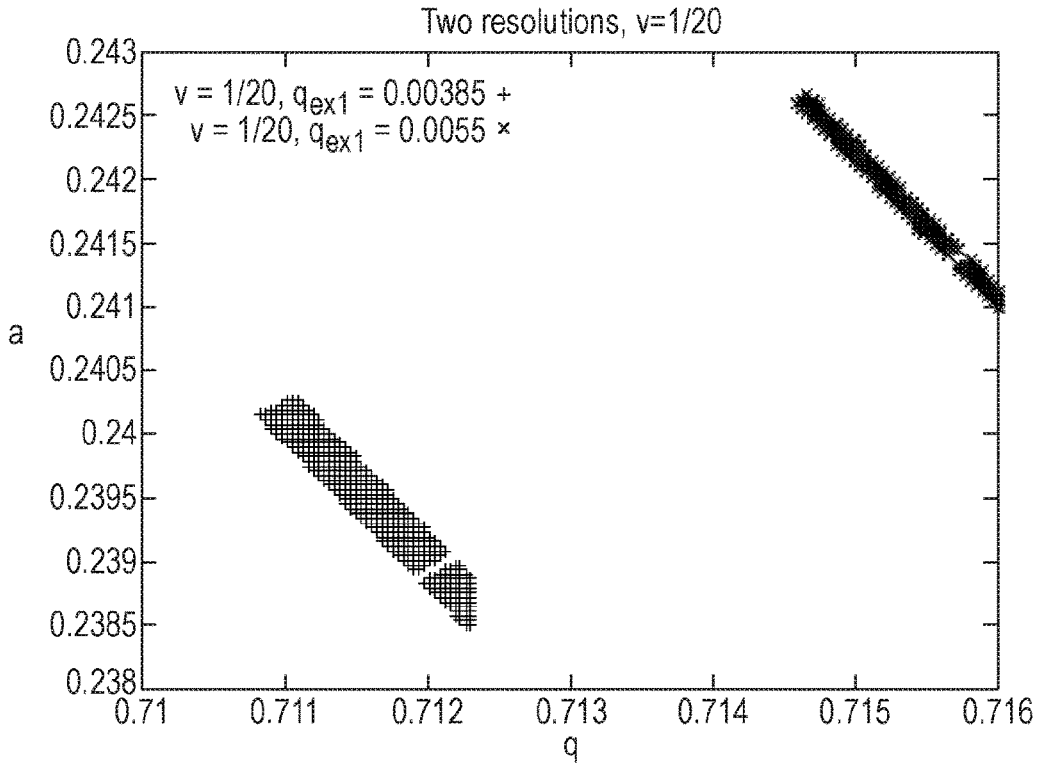
FIG. 9 shows two stability diagrams for a quadrupole mass filter operating in an X-band mode of operation, where $v=1/20$.

For comparison, FIG. 9 shows two X-bands at the tip of the stability diagram with the same Δq values as those in FIG. 8 but using a conventional X-band, with v=1/20 and $q_1$=0.00385 for the wider X-band, and $q_1$=0.0055 for the narrower X-band. The tip locations centre for the two X-bands are q=0.711 and q=0.7146.

Figure 10:
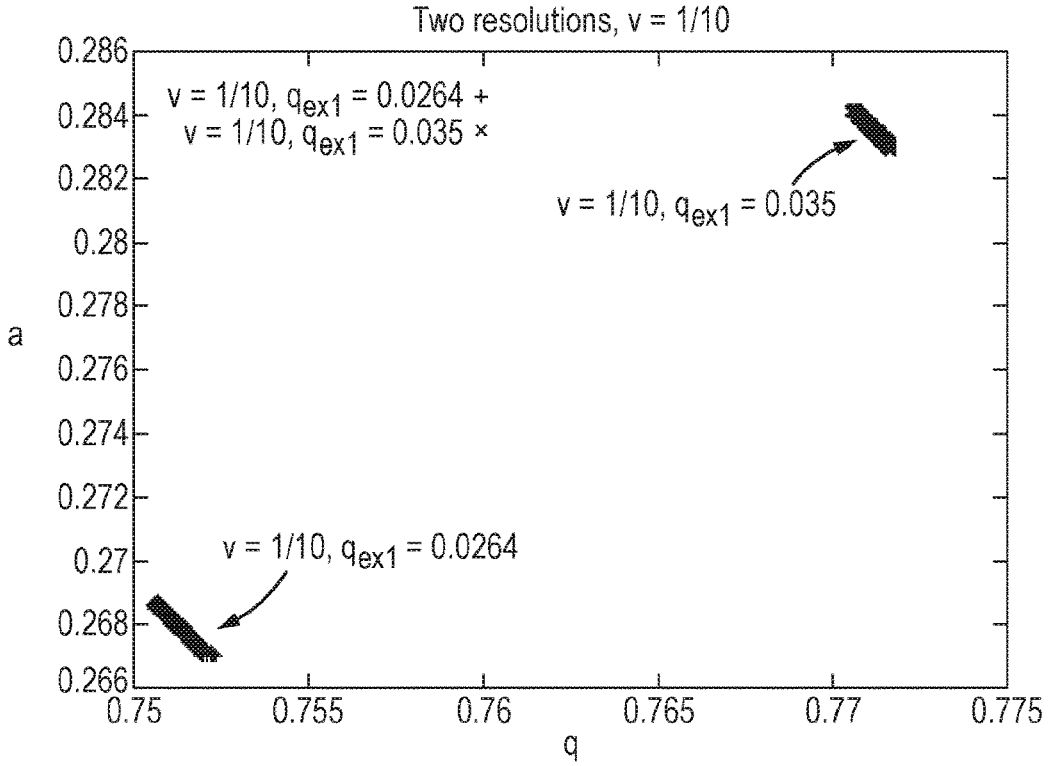
FIG. 10 shows two stability diagrams for a quadrupole mass filter operating in an X-band mode of operation, where $v=1/10$.

FIG. 10 shows two X-bands at the tip of the stability diagram with the same Δq value as those in FIG. 8 but using a conventional X-band, with v=1/10 and $q_1$=0.0264 for the wider X-band and $q_1$=0.035 for the narrower X-band. The tip locations $q_{centre}$ for the two bands are q=0.75 and q=0.77

The shift in the working point as resolution changes can be clearly seen. Blending of two or more X-bands, e.g. with different values of the base frequency v, in accordance with various embodiments can be used to control this effect.

As described above, in FIG. 4, the phase offset between the two pairs of excitations (e.g. which may have base frequencies v(a) and v(b)) is set to zero. However, any phase offset may be chosen (although a phase offset of zero is beneficial).

Figure 11:
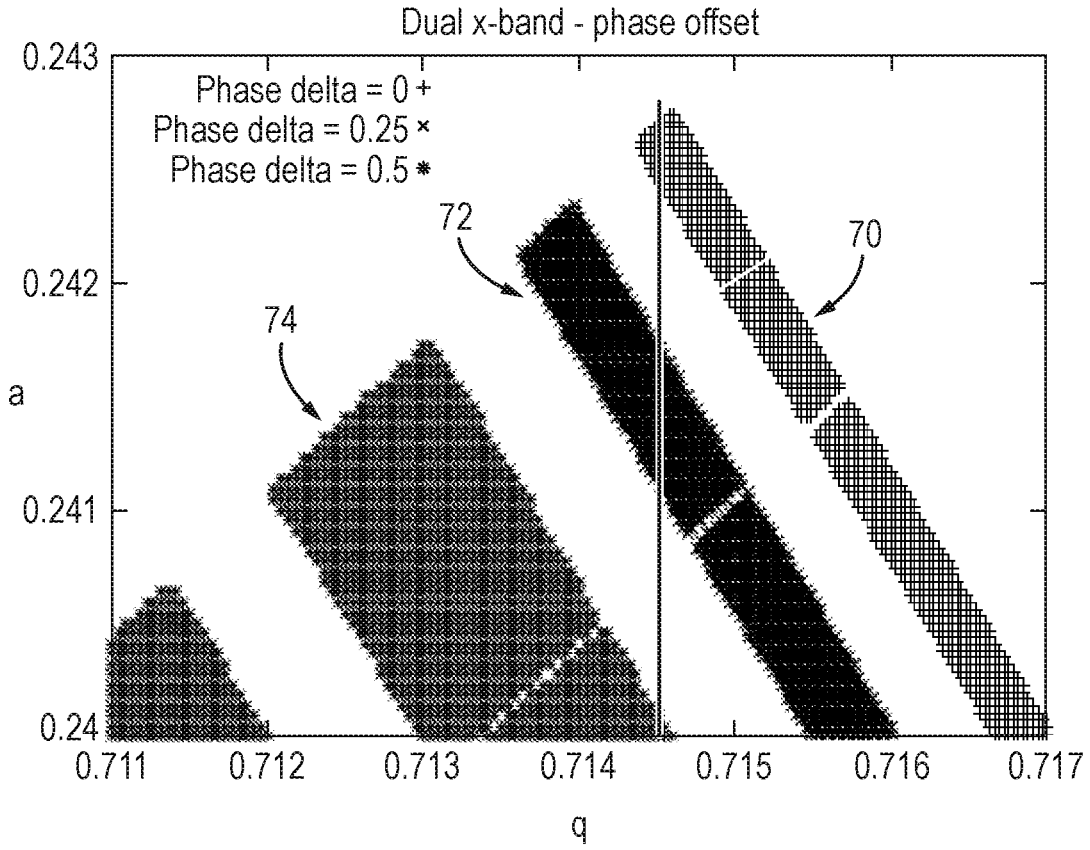
FIG. 11 shows stability diagrams for a quadrupole mass filter operating in a hybrid X-band mode of operation in accordance with various embodiments with different phase offsets between the excitations with base frequencies v(a) and v(b)

FIG. 11 shows the zoomed in region of the tip of the stability diagram in FIG. 4 for the combination of the same excitations but with different phase offsets between the first and second pairs of auxiliary voltages (e.g. the excitations with base frequencies v(a) and v(b)).

As the phase difference is changed from zero (plot 70) to 0.25(2π) (plot 72) to 0.5(2π) (plot 74) the resolution drops and the centre of the hybrid X-band drops to lower values of q. This has a similar effect as reducing the amplitude of the excitation waveforms.

Thus, adjustment of the phase difference in this way can provide control over the resolution, e.g. in addition to changing the relative or absolute amplitudes of the excitation waveforms, or alone. Thus, according to various embodiments, the phase difference between the two pairs of excitations may be selected and/or adjusted, e.g. in order to control the resolution.

Although various embodiments described above comprise combinations of "Type I" excitations (from Table 1), i.e. where $v_1$=v, and $v_2$=(1−v), it is possible to combine any type of X-band excitation with any other to produce a hybrid X-band in accordance with various embodiments.

Furthermore, for some combinations, the hybrid X-band mode of operation can be achieved by applying only three excitation waveforms (rather than four).

For example Type I and Type II excitations (from Table 1) can be combined, i.e. where for Type I: $v_1$=v, $v_2$=(1−v), and for Type 2: $v_1$=v, $v_2$=(1+v). Where both of these types of excitations have the same base frequency v (i.e. where v(a)=v(b)), only three different excitation waveforms need be applied to the quadrupole device 10.

Figure 12A:
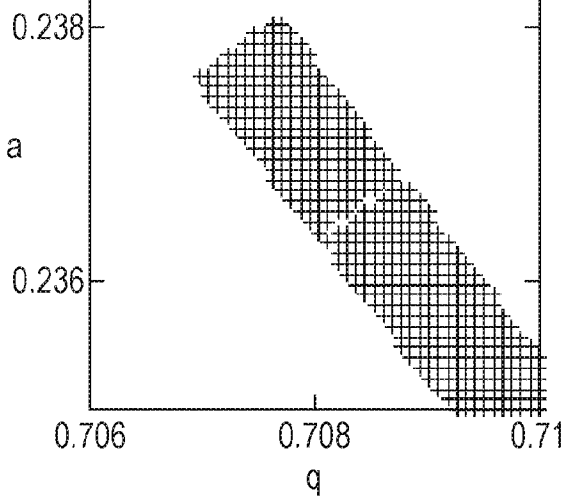
FIG. 12 shows stability diagrams for a quadrupole mass filter operating in a hybrid X-band mode of operation in accordance with various embodiments.
Figure 12B:
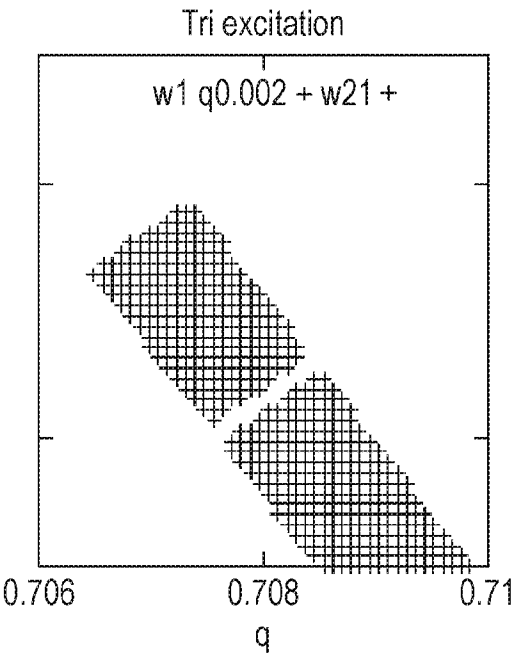
Figure 12C:
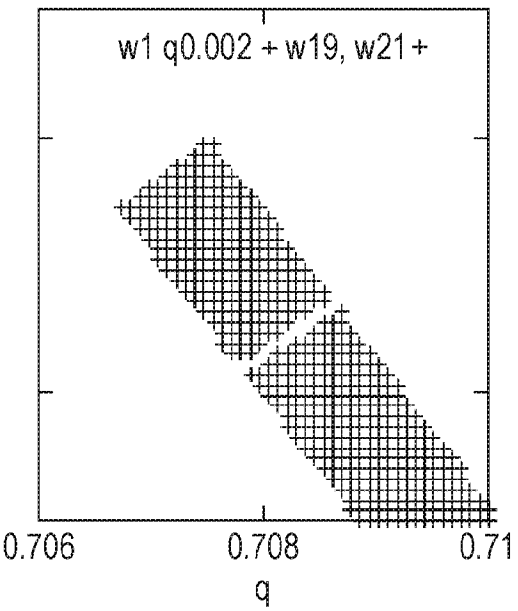

FIG. 12 shows the X-band at the tip of the stability diagram for three different excitation conditions. In FIG. 12A, v=1/20, $v_1$=v, $v_2$=(1−v), $q_{ext1}$=0.002, and $q_{ext2}/q_{ext1}$=2.915. In FIG. 12B, v=1/20, $v_1$=v, $v_2$=(1+v), $q_{ext1}$=0.002, and $q_{ext2}/q_{ext1}$=3.1. In FIG. 12C, v=1/20, $v_1$=v, $v_2$=(1−v), $v_3$=(1+v), $q_{ext1}$=0.002, $q_{ext2}/q_{ext1}$=2.915/2, and $q_{ext3}/q_{ext1}$=3.1/2.

It can be seen from FIG. 12 that the X-band stability is equivalent in all cases. However, the maximum amplitude of excitations required for the embodiment where three excitations are applied (resulting in a hybrid stability diagram) is half of the maximum amplitude required for the single X-band excitation waveforms.

Other combinations with common frequency can be shown to give a similar result. For example Type I and III excitations (from Table 1) have a common frequency (1−v). Therefore, three waveforms may be applied to produce a hybrid X band: $v_1$=(1−v), $v_2$=v, $v_3$=(2−$v_1$). Many other combinations are possible.

For simplicity, these modes of operation wherein the quadrupole device is operated using three auxiliary drive voltages may be described herein in terms of operating the quadrupole device with two pairs of auxiliary drive voltages, e.g. where two of the auxiliary drive voltages share a frequency in common. In these embodiments, the relationships between the amplitudes, frequencies and/or phases of the various plural may be described using the equations described herein, even though in practice only three auxiliary drive voltages may be applied to the quadrupole device 10.

It will be appreciated from the above that various embodiments allow X-band or Y-band operation using practical excitation amplitudes over an extended mass to charge ratio (m/z) range without introducing discontinuities as the applied waveforms are altered. This allows robust mass to charge ratio (m/z) calibration.

Although various embodiments above have been described in terms of the use of two X-band stability conditions, it would also be possible to use two Y-band stability conditions to form a hybrid Y-band, e.g. in a corresponding manner, mutatis mutandi. A Y-band may be produced and used for mass to charge ratio (m/z) filtering (rather than an X-band) by application of suitable excitation frequencies. Blending these excitation waveforms to produce a hybrid stability diagram can also be effected by the methods described.

As described above, the quadrupole device 10 (e.g. quadrupole mass filter) may be operated using one or more sinusoidal, e.g. analogue, RF or AC signals. However, it is also possible to operate the quadrupole device 10 using one or more digital signals, e.g. for one or more or all of the applied drive voltages. A digital signal may have any suitable waveform, such as a square or rectangular waveform, a pulsed EC waveform, a three phase rectangular waveform, a triangular waveform, a sawtooth waveform, a trapezoidal waveform, etc.

In digitally driven quadrupoles (operating in the normal mode), the frequency Ω of the main RF voltage can be altered (e.g. scanned) to change the set mass (mass to charge ratio (m/z)) of the quadrupole device, i.e. instead of altering (e.g. scanning) the ratio $V_{RF}$/U. Furthermore, (in the normal mode) the duty cycle of the digital waveform can be altered, e.g. to position the tip of the stability diagram on the a=0 line. This allows mass filtering without using a resolving DC voltage (i.e. where equal and opposite voltages are applied sequentially as the digital waveform). Adjustment of the resolution may then be accomplished by adjustment of the duty cycle.

According to various embodiments, a digitally driven quadrupole may be operated in the X-band or Y-band mode. Similar X-band or Y-band instability characteristics can be shown to exist for a digital drive voltage (compared to an analogue (harmonic) drive voltage), but the auxiliary waveforms require slightly different amplitude, frequency and phase characteristics.

Figure 13:
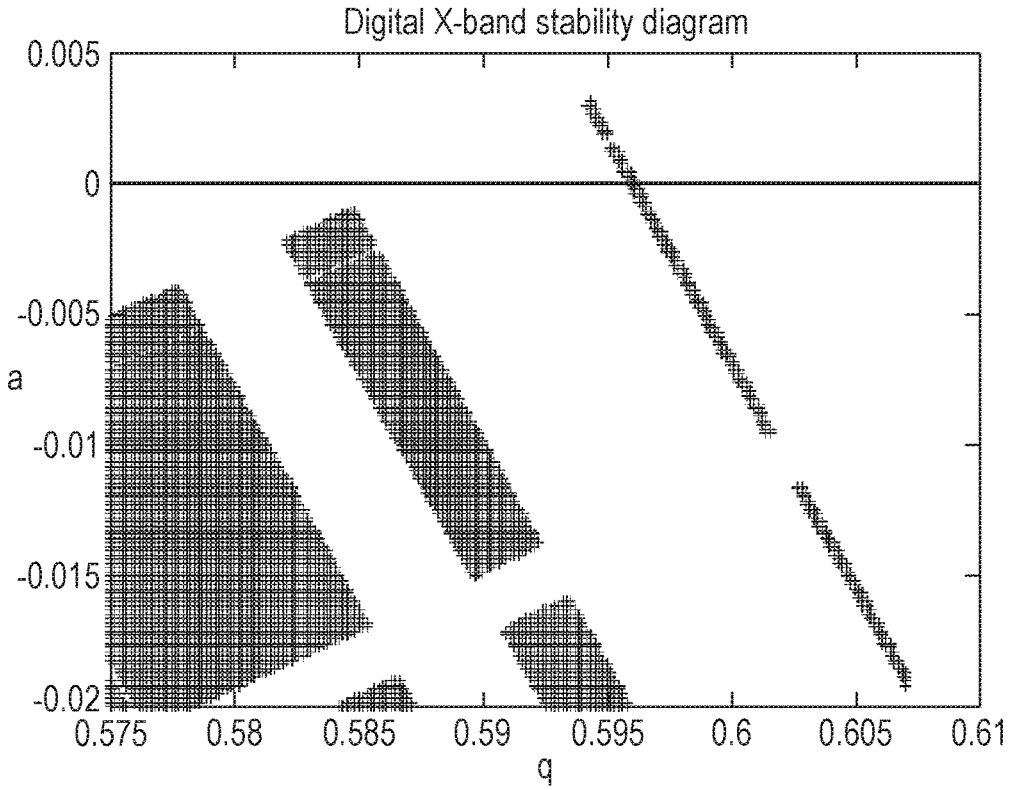
FIG. 13 shows a stability diagram for a quadrupole mass filter operating in a digital X-band mode of operation, where v=1/20, and qex1=0.003.

FIG. 13 shows an example stability diagram for a digitally driven quadrupole operating in an X-band mode. The duty cycle of the main waveform is 61.15/38.85. The duty cycle of each of the auxiliary waveforms is 50/50, where the base frequency v=1/20, and $q_{ex1}$=0.003. Also shown in FIG. 13 is the scan line with a=0. The working point is where this line cuts across the X-band.

In a digital system, it is practically feasible to scan the drive voltage frequencies, hence smooth calibration functions over a wide resolution range can be obtained by smoothly scanning the auxiliary frequencies. Thus, according to various embodiments, the frequency Ω of the main drive voltage and/or the frequencies $\omega_{exn}$ of the auxiliary drive voltages are scanned, altered and/or varied to scan, alter and/or vary the set mass of the quadrupole device 10.

According to various embodiments, in the X-band (or Y-band) mode, the duty cycle of the main waveform can be adjusted to position the X-band (or Y-band) working point on the a=0 line. Thus according to various embodiments, the quadrupole device 10 may be operated in the X-band (or Y-band) mode without applying a resolving DC voltage to the quadrupole device 10.

In a digitally driven quadrupole operating in the normal mode without a resolving DC voltage, the resolution may be controlled by precise adjustment of the duty cycle (this is analogous to precise control of the UN ratio). In contrast, in the digital X-band (or Y-band) mode of operation, the resolution may be controlled by adjustment of the parameters of the auxiliary voltages. This means that in the digital X-band (or Y-band) mode of operation, it is not necessary to be able to control the duty cycle precisely, i.e. a considerably coarser level of control of the duty cycle is sufficient. This makes the hardware requirements less exacting.

In order to extract useful mass to charge ratio (m/z) data the quadrupole mass filter 10 may be calibrated. During calibration, the relationship between transmitted mass to charge ratio (m/z) and applied RF voltage $V_{RF}$ may be determined, e.g. using a reference standard comprising species with multiple mass to charge ratio (m/z) values. The form of this calibration may depend on the values of U, v, $V_{ext1}$, $V_{ext2}$, $V_{ext3}$, $V_{ext4}$ chosen at each mass to charge ratio (m/z) value to give the desired performance.

The relationship between the operational parameters required for desired performance and $V_{RF}$ may be determined during a set-up procedure, e.g. using standard reference compounds. In effect there may be a set of calibration functions relating each of $V_{RF}$, the DC/RF ratio (U/$V_{RF}$), $V_{ext1}$ and $V_{ext3}$ to mass to charge ratio (m/z). ($V_{ext2}$ and $V_{ext4}$ may be simply related to $V_{ext1}$ and $V_{ext3}$ respectively). While the calibration of $V_{RF}$ to mass to charge ratio (m/z) is usually referred to, it should be understood that the other parameters are also effectively calibrated.

For best results it is desirable that the form of the calibration function(s) should take into account the predicted general relationship between the changing operational parameters and mass to charge ratio (m/z) range transmitted.

As described above, in various modes of operation the operational parameters of the quadrupole device 10 may be scanned continuously, e.g. to produce a mass spectrum. In these modes, it is beneficial to have a smooth transition between one mode of operation and the other, e.g. to avoid discontinuities. In these continuous scanning modes a single complex calibration function (set) may be required and used.

In modes of operation described above where the quadrupole mass filter transitions between an X-band mode with excitation waveforms with one value of v and an X-band mode with excitation waveforms with a different value of v, where the two different excitation waveforms with different values of v are applied simultaneously during a transition region, a single complex calibration function (set) may be required and used.

The form of the (or each) calibration curve may transition between a function characteristic of the first X-band waveform, to a function characteristic of a varying blend of two X-band waveforms, to a function characteristic of the second X-Band waveform.

To adequately mass calibrate during operation where the quadrupole device 10 transitions between these two or more modes of operation, the mass to charge ratio (m/z) calibration function(s) may be of a form which reflects these different characteristics and the characteristic at the transition region.

According to various embodiments, the quadrupole device 10 may be part of an analytical instrument such as a mass and/or ion mobility spectrometer. The analytical instrument may be configured in any suitable manner.

Figure 14:
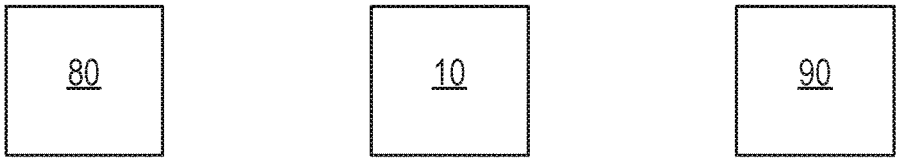
FIGS. 14 and 15 show schematically various analytical instruments comprising a quadrupole device in accordance with various embodiments.

FIG. 14 shows an embodiment comprising an ion source 80, the quadrupole device 10 downstream of the ion source 80, and a detector 90 downstream of the quadrupole device 10.

Ions generated by the ion source 80 may be injected into the quadrupole device 10. The plural voltages applied to the quadrupole device 10 may cause the ions to be radially confined within the quadrupole device 10 and/or to be selected or filtered according to their mass to charge ratio, e.g. as they pass through the quadrupole device 10.

Ions that emerge from the quadrupole device 10 may be detected by the detector 90. An orthogonal acceleration time of flight mass analyser may optionally be provided, e.g. adjacent the detector 90

Figure 15:
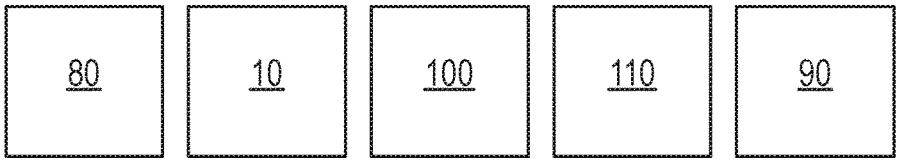

FIG. 15 shows a tandem quadrupole arrangement comprising a collision, fragmentation or reaction device 100 downstream of the quadrupole device 10, and a second quadrupole device 110 downstream of the collision, fragmentation or reaction device 100. In various embodiments, one or both quadrupoles may be operated in the manner described above.

In these embodiments, the ion source 80 may comprise any suitable ion source. For example, the ion source 80 may be selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; (xxix) a Surface Assisted Laser Desorption Ionisation ("SALDI") ion source; and (xxx) a Low Temperature Plasma ("LTP") ion source.

The collision, fragmentation or reaction device 100 may comprise any suitable collision, fragmentation or reaction device. For example, the collision, fragmentation or reaction device 100 may be selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

Various other embodiments are possible. For example, one or more other devices or stages may be provided upstream, downstream and/or between any of the ion source 80, the quadrupole device 10, the fragmentation, collision or reaction device 100, the second quadrupole device 110, and the detector 90.

For example, the analytical instrument may comprise a chromatography or other separation device upstream of the ion source 80. The chromatography or other separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The analytical instrument may further comprise: (i) one or more ion guides; (ii) one or more ion mobility separation devices and/or one or more Field Asymmetric Ion Mobility Spectrometer devices; and/or (iii) one or more ion traps or one or more ion trapping regions.

Although the present invention has been described with reference to preferred embodiments, it will be understood by those skilled in the art that various changes in form and detail may be made without departing from the scope of the invention as set forth in the accompanying claims.

The invention claimed is:

1. A method of operating a quadrupole device comprising:

applying a main drive voltage to the quadrupole device; and applying three or more auxiliary drive voltages simultaneously to the quadrupole device;

wherein the three or more auxiliary drive voltages correspond to two or more pairs of X-band or Y-band auxiliary drive voltages that produce two or more X-band or Y-band modes of operation.

2. A method as claimed in claim 1, wherein:

each of the three or more auxiliary drive voltages has a different frequency to the main drive voltage; and/or the three or more auxiliary drive voltages comprise three or more auxiliary drive voltages having at least three different frequencies.

3. A method as claimed in claim 1, further comprising applying one or more DC voltages to the quadrupole device.

4. A method as claimed in claim 1, wherein:

the main drive voltage has a frequency $\Omega$; and the three or more auxiliary drive voltages comprise a first pair of auxiliary drive voltages comprising a first auxiliary drive voltage having a first frequency $\omega_{ex1}$, and a second auxiliary drive voltage having a second frequency $\omega_{ex2}$, wherein the main drive voltage frequency $\Omega$ and the first and second frequencies $\omega_{ex1}$, $\omega_{ex2}$ are related by $\omega_{ex1}=v_1\Omega$, and $\omega_{ex2}=v_2\Omega$, where $v_1$ and $v_2$ are constants; and/or the three or more auxiliary drive voltages comprise a second pair of auxiliary drive voltages comprising a third auxiliary drive voltage having a third frequency $\omega_{ex3}$, and a fourth auxiliary drive voltage having a fourth frequency $\omega_{ex4}$, wherein the main drive voltage frequency $\Omega$ and the third and fourth frequencies $\omega_{ex3}$, $\omega_{ex4}$ are related by $\omega_{ex3}=v_3\Omega$, and $\omega_{ex4}=v_4\Omega$, where $v_3$ and $v_4$ are constants.

5. A method as claimed in claim 4, wherein:

the first pair of auxiliary drive voltages comprises (i) a first auxiliary drive voltage pair type, wherein $v_1=v(a)$ and $v_2=1-v(a)$; (ii) a second auxiliary drive voltage pair type, wherein $v_1=v(a)$ and $v_2=1+v(a)$; (iii) a third auxiliary drive voltage pair type, wherein $v_1=1-v(a)$ and $v_2=2-v(a)$; (iv) a fourth drive voltage pair type, wherein $v_1=1-v(a)$ and $v_2=2+v(a)$; (v) a fifth auxiliary drive voltage pair type, wherein $v_1=1+v(a)$ and $v_2=2-v(a)$; or (vi) a sixth auxiliary drive voltage pair type, wherein $v_1=1+v(a)$ and $v_2=2+v(a)$; and/or the second pair of auxiliary drive voltages comprises (i) a first auxiliary drive voltage pair type, wherein $v_3=v(b)$ and $v_4=1-v(b)$; (ii) a second auxiliary drive voltage pair type, wherein $v_3=v(b)$ and $v_4=1+v(b)$; (iii) a third auxiliary drive voltage pair type, wherein $v_3=1-v(b)$ and $v_4=2-v(b)$; (iv) a fourth drive voltage pair type, wherein $v_3=1-v(b)$ and $v_4=2+v(b)$; (v) a fifth auxiliary drive voltage pair type, wherein $v_3=1+v(b)$ and $v_4=2-v(b)$; or (vi) a sixth auxiliary drive voltage pair type, wherein $v_3=1+v(b)$ and $v_4=2+v(b)$.

6. A method as claimed in claim 5, wherein $v(a)\neq(b)$.

7. A method as claimed in claim 5, wherein $v(a)=v(b)$, and wherein the three or more auxiliary drive voltages correspond to two different auxiliary drive voltage pair types of the first to sixth auxiliary drive voltage types.

8. A method as claimed in claim 1, wherein:

the three or more auxiliary drive voltages comprise a first auxiliary drive voltage having an first amplitude $V_{ex1}$, and a second auxiliary drive voltage having a second amplitude $V_{ex2}$, wherein the absolute value of the ratio of the second amplitude to the first amplitude $V_{ex2}/V_{ex1}$ is in a range 1-10; and/or the three or more auxiliary drive voltages comprise a third auxiliary drive voltage having a third amplitude $V_{ex3}$, and a fourth auxiliary drive voltage having a fourth amplitude $V_{ex4}$, wherein the absolute value of the ratio of the fourth amplitude to the third amplitude $V_{ex4}/V_{ex3}$ is in a the range 1-10.

9. A method as claimed in claim 1, further comprising altering a resolution or a mass to charge ratio range of the quadrupole device.

10. A method as claimed in claim 9, comprising altering the resolution or the mass to charge ratio range of the quadrupole device by: (i) altering an amplitude of one or more of the auxiliary drive voltages; (ii) altering a phase difference between two or more of the auxiliary drive voltages; and/or (iii) altering a duty cycle of the main drive voltage.

11. A method as claimed in claim 9, comprising altering the resolution or the mass to charge ratio range of the quadrupole device by altering an amplitude ratio between two or more of the auxiliary drive voltages.

12. A method as claimed in claim 9, comprising altering the resolution or the mass to charge ratio range of the quadrupole device by altering the ratio of the first and/or second amplitude to the third and/or fourth amplitude.

13. A method as claimed in claim 1, further comprising:

operating the quadrupole device in a first X-band mode of operation, wherein the main drive voltage and two auxiliary drive voltages are applied to the quadrupole device; and then operating the quadrupole device in a mode of operation in which the main drive voltage and the three or more auxiliary drive voltages are applied to the quadrupole device.

14. A method as claimed in claim 1, further comprising:

operating the quadrupole device in a mode of operation in which the main drive voltage and the three or more auxiliary drive voltages are applied to the quadrupole device; and then operating the quadrupole device in a second X-band mode of operation, wherein the main drive voltage and two auxiliary drive voltages are applied to the quadrupole device.

15. A method as claimed in claim 1, wherein the main drive voltage and/or the three or more auxiliary drive voltages comprises digital drive voltages.

16. A method of mass and/or ion mobility spectrometry comprising:

operating a quadrupole device using the method of claim 1; and passing ions though the quadrupole device such that the ions are selected and/or filtered according to their mass to charge ratio.

17. A quadrupole device comprising:

a plurality of electrodes; and one or more voltage sources configured to:

apply a main drive voltage to the electrodes; and apply three or more auxiliary drive voltages simultaneously to the electrodes;

wherein the three or more auxiliary drive voltages correspond to two or more pairs of X-band or Y-band auxiliary drive voltages that produce two or more X-band or Y-band modes of operation.

18. A mass and/or ion mobility spectrometer comprising a quadrupole device as claimed in claim 17.

19. A method of operating a quadrupole device comprising:

applying a main drive voltage to the quadrupole device;

applying three or more auxiliary drive voltages to the quadrupole device, wherein the three or more auxiliary drive voltages correspond to two or more pairs of X-band or Y-band auxiliary drive voltages that produce two or more X-band or Y-band modes of operation; and increasing a resolution of the quadrupole device while increasing a mass to charge ratio or mass to charge ratio range at which ions are selected and/or transmitted by the quadrupole device, or decreasing a resolution of the quadrupole device while decreasing a mass to charge ratio or mass to charge ratio range at which ions are selected and/or transmitted by the quadrupole device.

* * * * *